US007859495B2

(12) United States Patent
Asano et al.

(10) Patent No.: US 7,859,495 B2
(45) Date of Patent: Dec. 28, 2010

(54) IMAGE DISPLAY APPARATUS

(75) Inventors: Mitsuru Asano, Kanagawa (JP); Junichi Yamashita, Tokyo (JP); Akira Yumoto, Kanagawa (JP); Hiroshi Fujimura, Aichi (JP)

(73) Assignee: Sony Corporation, Tokyo (JP)

( * ) Notice: Subject to any disclaimer, the term of this patent is extended or adjusted under 35 U.S.C. 154(b) by 894 days.

(21) Appl. No.: 11/798,822

(22) Filed: May 17, 2007

(65) Prior Publication Data

US 2008/0001861 A1 Jan. 3, 2008

(30) Foreign Application Priority Data

May 23, 2006 (JP) ..... 2006-143327
Nov. 17, 2006 (JP) ..... 2006-310864

(51) Int. Cl.
*G09G 3/30* (2006.01)

(52) U.S. Cl. ..... 345/82; 345/76; 345/77; 345/84; 345/92

(58) Field of Classification Search ..... 345/76, 345/77, 82, 84, 92
See application file for complete search history.

(56) References Cited

U.S. PATENT DOCUMENTS 6,229,506 B1 5/2001 Dawson et al.
7,508,361 B2 * 3/2009 Uchino et al. ..... 345/76
7,545,351 B2 * 6/2009 Shin ..... 345/82

* cited by examiner

*Primary Examiner*—Richard Hjerpe
*Assistant Examiner*—Sahlu Okebato
(74) *Attorney, Agent, or Firm*—Rader, Fishman & Grauer PLLC

(57) ABSTRACT

Herein is disclosed an image display apparatus, including a pixel array section, and a peripheral circuit section. The pixel array section has a plurality of scanning lines extending along rows, a plurality of signal lines extending along columns, and a plurality of pixels disposed in a matrix at locations at which the scanning lines and the signal lines intersect with each other. The peripheral circuit section has a scanner and a driver. Each of the pixels contains a sampling transistor, a drive transistor, a switching transistor, and a light emitting element.

17 Claims, 20 Drawing Sheets

IMAGE DISPLAY APPARATUS

CROSS REFERENCES TO RELATED APPLICATIONS

The present invention contains subject matter related to Japanese Patent Application JP 2006-310864, filed in the Japan Patent Office on Nov. 17, 2006, the entire contents of which being incorporated herein by reference.

BACKGROUND OF THE INVENTION

1. Field of the Invention

This invention relates to an image display apparatus of the active matrix type, and more particularly to an image display apparatus wherein a light emitting element is used for each pixel and the light emitting period within one field is controlled to adjust the luminance. More specifically, the present invention relates to an image display apparatus wherein the difference in the light emitting period which appears between different scanning lines when sampling out or thinning out scanning or the like is performed is adjusted.

2. Description of the Related Art

An image display apparatus wherein a light emitting element is used in a pixel is already known and disclosed, for example, in U.S. Pat. No. 6,229,506.

An existing image display apparatus basically includes a pixel array section which forms a screen and a peripheral circuit section for driving the pixel array section. The pixel array section includes scanning lines extending along rows, signal lines extending along columns, and pixels disposed in a matrix at locations at which the scanning lines and the signal lines intersect with each other. The peripheral circuit section includes a scanner for supplying a sequential control signal in a predetermined transfer period to the scanning lines in order to perform line sequential scanning over one field, and a driver for supplying an image signal to the signal lines in accordance with the line sequential scanning. Each of the pixels includes a light emitting element, a plurality of transistors for driving the light emitting element, and so forth. The transistors are controlled at least through first and second scanning lines. The first scanning line samples the image signal in accordance with the line sequential scanning to cause light emitting elements to emit light. Meanwhile, the second scanning line controls the light emitting period of the light emitting elements.

The scanner included in the peripheral circuit section includes at least a first scanner for supplying a first control signal for image signal sampling to the first scanning line and a second scanner for supplying a second control signal for light emitting period control to the second scanning line. Both of the first and second scanners operate in response to a common clock signal to successively transfer different start pulses supplied thereto from the outside to supply the first and second control signals to the pixel array section side, respectively.

SUMMARY OF THE INVENTION

For an image display apparatus, different systems are available regarding the number of scanning lines. For example, the NTSC system defines the scanning line number as 525, and the PAL system defines the scanning line number as 625. To display an image signal of the PAL system on an image display apparatus of the NTSC system, then, because the line number of the image signal becomes greater in comparison with the scanning line number, it is necessary to use sampling out scanning. In the sampling out scanning, the first scanner for performing sampling of an image signal successively supplies, to the first scanning lines within one field, a first control signal for sampling control in a state wherein ordinary first transfer periods and second transfer periods longer than the first transfer period are mixed. By this, an unnecessary image signal is sampled out in a unit of a scanning line.

In the sampling out scanning, it is necessary to supply, to the first scanner, a clock signal which defines transfer periods in which ordinary transfer periods and second transfer periods longer than the first transfer periods are mixed. In an existing image display apparatus, a clock signal of a waveform same as that of the clock signal supplied to the first scanner is also supplied to the second scanner so as to output a second control signal for sequential light emitting period control to the second scanning lines. However, according to the method just described, the time width, which defines the light emitting period, of the second control signal supplied to the second scanning lines varies for each scanning row because of the mixed existence of the first and second transfer periods. Such variation of the time width makes it difficult to adjust the luminance so as to be uniform for each row over the overall screen, and this is a subject to be solved.

Therefore, it is demanded to provide an image display apparatus wherein, even when sampling out scanning or a similar operation performed, the light emitting period can be adjusted so as to be uniform for each pixel row or line.

According to an embodiment of the present invention, there is provided an image display apparatus, including a pixel array section, a peripheral circuit section configured to drive the pixel array section, the pixel array section having a plurality of scanning lines extending along rows, a plurality of signal lines extending along columns, and a plurality of pixels disposed in a matrix at locations at which the scanning lines and the signal lines intersect with each other, the peripheral circuit section having a scanner configured to supply sequential scanning signals in a predetermined transfer period to the scanning lines in order to perform line sequential scanning over one field and a driver configured to supply an image signal to the signal lines in accordance with the line sequential scanning, each of the pixels having a sampling transistor, a drive transistor, a switching transistor, and a light emitting element, the sampling transistor being able to conduct in response to a first control signal supplied from an associated first scanning line to sample an image signal supplied from an associated signal line, the drive transistor supplying output current in response to the image signal sampled by the sampling transistor to the light emitting element, the light emitting element emitting light with luminance in accordance with the image signal based on the output current supplied from the drive transistor, the switching transistor being disposed in a current path along which the output current flows in such a manner as to exhibit an on state in response to a time width of a second control signal supplied thereto from the second scanning line to supply the output current to the light emitting element so as to cause the light emitting element to emit light within a light emitting period in accordance with the time width, the scanner having a first scanner configured to supply the first control signals to the first scanning lines and a second scanner configured to supply the second control signals to the second scanning lines, the first scanner operating in response to a clock signal which defines a transfer period which includes ordinary first transfer periods and second transfer periods which are longer than and mixed in the first transfer periods to supply the first control signals sequentially in the first transfer periods and the second transfer periods which are mixed in the first transfer periods to the first scanning lines, the second scanner operating in response to a clock signal synchronized with the clock signal for the first scanner to sequentially supply the second control signals to the second scanning lines, whereupon the time width of the second control signals which defines the light emitting period varies for each row due to the mixture of the first transfer periods and the second transfer periods, the second scanner turning off the output of the second control signals in accordance with the second transfer periods thereby to adjust the light emitting period against variation caused by the mixture of the second transfer periods.

Preferably, the second scanner controls the output of the second control signals to an off state for a time width equal to the difference between the first transfer periods and the second transfer periods which are longer than the first transfer periods.

Preferably, the second scanner turns off, at a timing other than a timing at which the first scanner outputs the first control signals to the first scanning lines, the output of the second control signals of the corresponding second scanning lines.

Preferably, the second scanner logically ANDs the second control signals sequentially produced in response to the clock signal and a masking signal inputted from the outside in synchronism with the clock signal to control the output of the second control signals to an off state.

The image display apparatus may be configured such that the pixel array section has a predetermined number of scanning lines, and when the driver outputs a number of image signals greater than the number of the first scanning lines to the signal lines in accordance with the line sequential scanning, the first scanner supplies the first control signals sequentially in the first transfer periods and the second transfer periods mixed in the first transfer periods within one field thereby to sample out unnecessary image signals in a unit of a scanning line.

Preferably, the second scanner varies an output off period, within which the output of the second control signals is controlled to an off state in accordance with the second transfer period, in response to the light emitting period which depends upon the time width of the second control signals. In this instance, the second scanner may variably control the output off period so as to decrease as the light emitting period increases. Particularly, the image display apparatus may be configured such that the second scanner can vary the time width of the second control signals to variably adjust the light emitting period within a range from a minimum light emitting period to a maximum light emitting period within one field, and controls the output off period such that, when the light emitting period is the minimum light emitting period, the output off period is equal to the difference between the first transfer periods and the second transfer periods which are longer than the first transfer periods. In this instance, the second scanner may control the output off period so as to be zero when the light emitting period is the maximum light emitting period. Or, when the second scanner variably controls the output off period, the second scanner may fix the start point of the output off periods but vary the end point of the output off periods in response to the length of the light emitting period.

In the image display apparatus, the first scanner controls sampling (writing of data) of image signals while the second scanner controls the light emitting time of the light emitting element which forms each of the pixels. Where the number of scanning lines is different between the screen standards and the image signal standards, the transfer period of the first scanner for controlling the data writing timing is varied to sample out the input image signals in a unit of a line. If the first scanner for controlling the data writing timing and the second scanner for controlling the light emitting period operate otherwise with a common clock signal, then since they have a fixed phase relationship, also the transfer period of the second scanner for controlling the light emitting period is influenced by the first scanner such that the transfer period is varied, which results in differences in the light emitting period among different lines. Therefore, in the image display apparatus, masking is applied to the second control signals for controlling the light emitting period at a timing at which the transfer period is increased from an ordinary length thereof so as to turn off the output of the second control signals. Consequently, the light emitting period can be kept fixed among the individual lines without being influenced by the variation of the transfer period.

In the image display apparatus, the output off period within which the second scanner controls the output of the second control signals to an off state in accordance with the second transfer period is varied in response to the light emitting period which depends upon the time width of the second control signal. In particular, the second scanner variably controls the output off period so as to decreases as the light emitting period increases. Where the output off period is variably controlled in response to the light emitting period in this manner, reduction of the screen luminance can be suppressed and the influence of the power supply load variation can be reduced while the luminance difference between lines is elminated substantially.

According to another embodiment of the present invention, there is provided an image display apparatus including a pixel array section and a peripheral circuit section configured to drive the pixel array section, the pixel array section having a plurality of scanning lines extending along rows, a plurality of signal lines extending along columns, and a plurality of pixels disposed in a matrix at locations at which the scanning lines and the signal lines intersect with each other, the peripheral circuit section having a scanner configured to supply sequential scanning signals in a predetermined transfer period to the scanning lines in order to perform line sequential scanning over one field and a driver configured to supply an image signal to the signal lines in accordance with the line sequential scanning, each of the pixels having a sampling transistor, a drive transistor, a switching transistor, and a light emitting element, the sampling transistor being rendered conducting in response to a first control signal supplied from an associated first scanning line to sample an image signal supplied from an associated signal line, the drive transistor supplying output current in response to the image signal sampled by the sampling transistor to the light emitting element, the light emitting element emitting light with luminance in accordance with the image signal based on the output current supplied from the drive transistor, the switching transistor being disposed in a current path along which the output current flows in such a manner as to exhibit an on state in response to a time width of a second control signal supplied thereto from the second scanning line to supply the output current to the light emitting element so as to cause the light emitting element to emit light within a light emitting period in accordance with the time width, the scanner having a first scanner configured to supply the first control signals to the first scanning lines and a second scanner configured to supply the second control signals to the second scanning lines, the first scanner operating in response to a first clock signal which defines a transfer period which includes ordinary first transfer periods and second transfer periods which are longer than and mixed in the first transfer periods to supply the first control signals sequentially in the first transfer periods and the second transfer periods which are mixed in the first transfer periods to the first scanning lines, the second scanner operating in response to a second clock signal which defines a third transfer period, different from the first and second transfer periods, to sequentially supply the second control signals having a predetermined time width to the second scanning lines such that the light emitting period of the pixels of the rows without being influenced by the mixture of the first and second transfer periods.

Preferably, the second scanner operates in response to a second clock signal which defines a fixed third transfer period to sequentially supply the second control signals having a same time width to the second scanning lines such that the light emitting period of the pixels of the rows is controlled so as to be always the same without being influenced by the mixture of the first and second transfer periods.

Preferably, the second scanner operates in response to a clock signal which defines a third transfer period which is equal to an average value of the transfer periods in which the first and second transfer periods are mixed.

Preferably, each of the pixels further includes a correcting transistor configured to cooperate with the switching transistor to perform a correction operation of the drive transistor within a predetermined correction period, and the scanner includes, in addition to the first and second scanners, a third scanner configured to supply a third control signal to the correcting transistor through a third scanning line, the third scanner sequentially outputting the third control signals to the third scanning lines in response to a clock signal synchronized with the second clock signal which is supplied to the second scanner.

Or, the image display apparatus may be configured such that each of the pixels further includes a correcting transistor configured to cooperate with the switching transistor to perform a correction operation of the drive transistor within a predetermined correction period, and the scanner includes, in addition to the first and second scanners, a third scanner configured to supply a third control signal to the correcting transistor through a third scanning line, the third scanner sequentially outputting the third control signals to the third scanning lines in response to a clock signal synchronized with the first clock signal which is supplied to the second scanner.

Or, the image display apparatus may be configured such that each of the pixels further includes a correcting transistor configured to cooperate with the switching transistor and the sampling transistor to perform a correction operation of the drive transistor within a predetermined correction period, and the second scanner further includes a shift register configured to produce the second control signals in response to the second clock signal, another shift register configured to produce additional control signals in response to the first clock signal, and an outputting section configured to output the sums of the additional control signals and the second control signals to the second scanning lines of the rows, the scanner including, in addition to the first and second scanners, a third scanner configured to supply the third control signals to the correcting transistors through third scanning lines, the third scanner sequentially outputting the third control signals to the third scanning lines in response to a clock signal synchronized with the first clock signal supplied to the first scanner.

The image display apparatus may be configured such that the pixel array section has a predetermined number of scanning lines, and when the driver outputs a number of image signals greater than the number of the first scanning lines to the signal lines in accordance with the line sequential scanning, the first scanner supplies the first control signals sequentially in the first transfer periods and the second transfer periods mixed in the first transfer periods within one field thereby to sample out unnecessary ones of the image signals in a unit of a scanning line.

In the image display apparatus, the first and second scanners are controlled so as to be asynchronous with each other to prevent variation of the light emitting period. In particular, when sampling out scanning is performed, the first clock signal which defines the transfer period which includes the ordinary first transfer periods and the second transfer periods which are longer than and mixed in the first transfer periods is supplied to the first scanner for controlling sampling of the image signals. Meanwhile, the second clock signal which is asynchronous with the first clock signal and defines the third transfer period which is equal to an average value of the transfer periods in which the first and second transfer periods are mixed is supplied to the second scanner for controlling the light emitting period. Consequently, the second scanner can supply the second control signals to the individual second scanning lines always in a fixed transfer period without being influenced by the variation of the transfer period of the first scanner side. Consequently, the image display apparatus can display an image of high quality in a sampled out fashion.

The above and other features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

Figure 1:
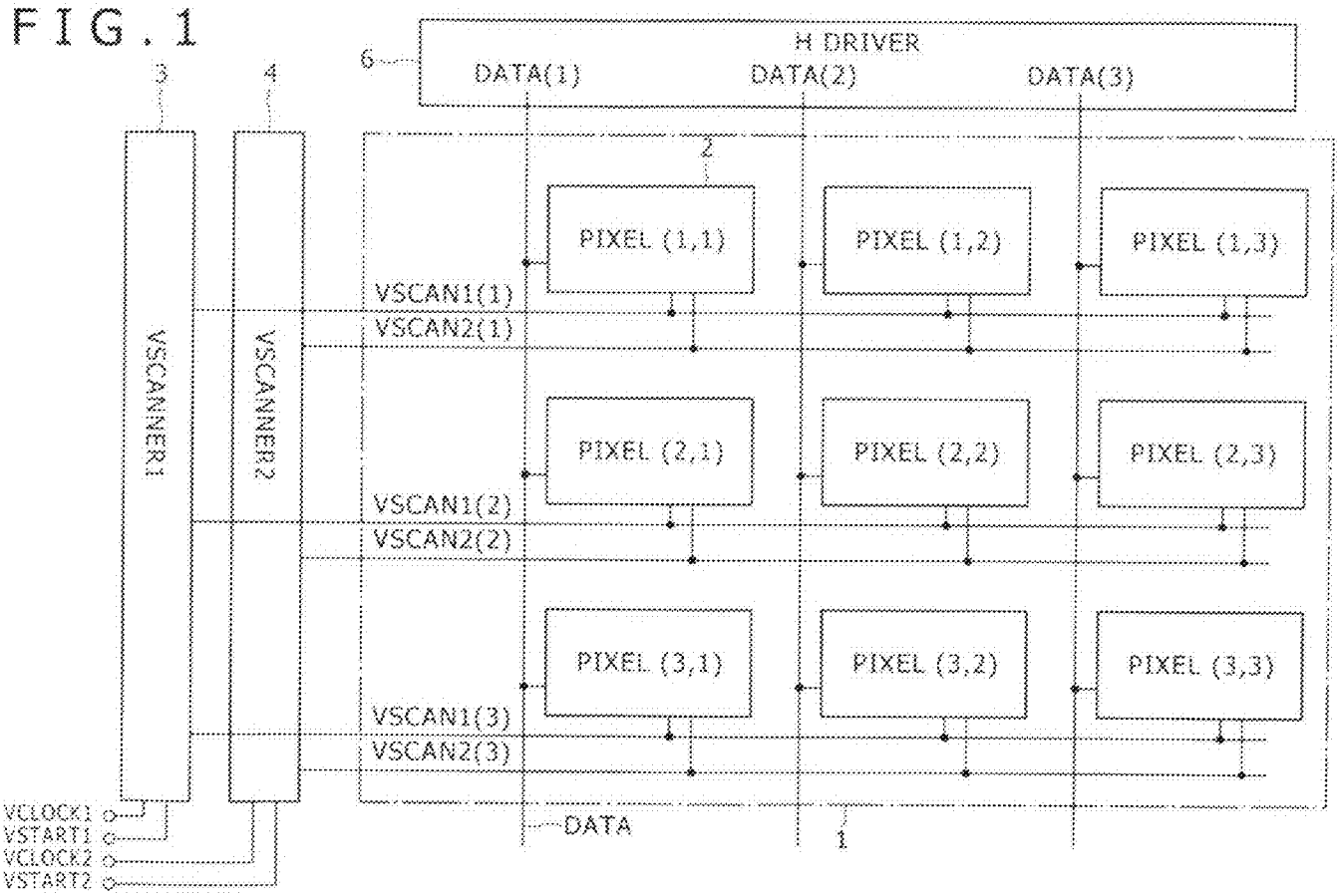
FIG. 1 is a block diagram showing a general configuration of an image display apparatus to which the present invention is applied.

Referring first to FIG. 1, there is shown a general configuration of an image display apparatus to which the present invention is applied. The image display apparatus shown basically includes a pixel array section 1, and a peripheral circuit section for driving the pixel array section 1. The pixel array section 1 includes scanning lines VSCAN extending along rows, data lines DATA extending along columns, and pixels 2 disposed in a matrix at locations at which the scanning lines VSCAN and the data lines DATA intersect with each other. In FIG. 1, each pixel 2 is distinguished by a row number and a column number in parentheses added thereto. Also the row number of each corresponding scanning line VSCAN is indicated in parentheses. Meanwhile, the peripheral circuit section includes a scanner for supplying a sequential control signal in a predetermined transfer period to the scanning lines VSCAN in order to perform line sequential scanning over one field, and a horizontal (H) driver 6 for supplying an image signal (data) to the data lines DATA in accordance with the line sequential scanning.

Each pixel 2 at least includes a sampling transistor, a drive transistor, a switching transistor, and a light emitting element such as an organic EL (electroluminescence) element. The sampling transistor is rendered conducting in response to the first control signal supplied from the first scanning line VSCAN1 to sample an image signal supplied from the associated signal line DATA. The drive transistor supplies output current in accordance with the sampled image signal to the light emitting element. The light emitting element emits light in accordance with the image signal based on the output current supplied thereto from the drive transistor. The switching transistor is disposed on a current path along which the output current flows, and exhibits an on state in accordance with the time width of the second control signal supplied thereto from the second scanning line VSCAN2 to supply the output current to the light emitting element so that the light emitting element emits light within a light emitting period in accordance with the light emitting period. The screen luminance can be adjusted by adjustment of the time width.

The scanner is divided into a first scanner (Vscanner1) 3 for supplying a first control signal to the first scanning lines VSCAN1 and a second scanner (Vscanner2) 4 for supplying a second control signal to the second scanning lines VSCAN2. The first scanner 3 operates in response to a clock signal (Vclock1) which defines transfer periods in which ordinary first transfer periods T1 and second transfer periods T2 which are longer than the first transfer periods T1 are mixed within one field to successively transfer a start pulse (Vstart1) supplied thereto from the outside thereby to supply a sequential first control signal in the first transfer periods T1 and second transfer periods T2 mixed in the first transfer periods T1 to the first scanning lines VSCAN1(*i*). Meanwhile, the second scanner 4 (Vscanner2) operates in response to a clock signal Vclock2 synchronized with the clock signal Vclock1 of the first scanner 3 to successively transfer another start pulse (Vstart2) thereby to supply a sequential second control signal to the second scanning lines VSCAN2(*i*). The second control signal has a waveform same as that of the start pulse (Vstart2), and the start pulse has a pulse width equal to the time width of the second control signal. Here, since the second scanner 4 operates with the clock signal synchronized with the first scanner 3, also the second scanner 4 side is influenced by the mixture of the first transfer periods T1 and the second transfer periods T2 such that the time width of the second control signals which defines the light emitting period varies for each pixel row (line). In order to cope with this, the second scanner 4 turns off the output of the second control signals in accordance with the second transfer period T2 thereby to adjust the emitting period against variation caused by the mixture of the second transfer periods T2.

Preferably, the second scanner 4 controls the output of the second control signals to an off state for a period of a time width T2−T1 equal to the difference between the first transfer period T1 and the second transfer period T2 which is longer than the first transfer period T1. Preferably, the second scanner 4 turns off the output of the second control signal for each second scanning line VSCAN2(*i*) at a timing other than the timing at which the first control signal is outputted to the corresponding first scanning line VSCAN1(*i*). In other words, the second scanner 4 turns off the output of the second control signals except the timings at which an image signal is sampled on the lines. Consequently, a potential variation in the pixel arrays caused by turning off of the output of the second control signal is prevented from having a bad influence on the sampling operation of the image signal. It is to be noted that the second scanner 4 logically ANDs the second control signals successively produced in response to the clock signal (Vclock2) and a masking signal inputted from the outside in synchronism with the clock signal to turn off the output of the second control signals.

Such a driving method as described above is adopted where the image display apparatus performs sampling out scanning. The pixel array section 1 has a predetermined number of first scanning lines VSCAN1. Here, when the H driver 6 outputs a number of image signals greater than the number of first scanning lines VSCAN1 to the data lines DATA in accordance with line sequential scanning, the first scanner 3 supplies the sequential first control signal in the first transfer periods T1 and the second transfer periods T2 mixed in the first transfer periods T1 to the first scanning lines VSCAN1 within one field thereby to sample out unnecessary image signals in a unit of a scanning line VSCAN.

Meanwhile, in another form, the second scanner 4 operates in response to the second clock signal (Vclock2), which is not in synchronism with the first clock signal (Vclock1) supplied to the first scanner 3 and defines a third transfer period different from the first transfer period T1 and the second transfer period T2, to sequentially transfer the start pulse Vstart2 to supply a second control signal having a predetermined time width to the second scanning lines VSCAN2(*i*). Consequently, the second scanner 4 can control the light emitting period of the pixels 2 of each row without being influenced by the mixture of the first transfer periods T1 and the second transfer period T2 of the first scanner 3 side. In this instance, the second scanner 4 operates in response to the clock signal Vclock2 which defines the fixed third transfer period to sequentially supply second control signals having the same time width to the second scanning lines VSCAN2(*i*). Consequently, the light emitting periods of the pixels 2 in the rows can be controlled so as to be equal to each other without being influenced by the mixture of the first transfer periods T1 and the second transfer periods T2. Preferably, the second scanner 4 operates in response to the clock signal Vclock2 which defines the third transfer period which is equal to an average value of the transfer periods in which the first transfer periods T1 and the second transfer period T2 are included in a mixed condition. Consequently, the first scanner 3 and the second scanner 4 operate synchronously in a unit of one field although they operate asynchronously.

Figure 2:
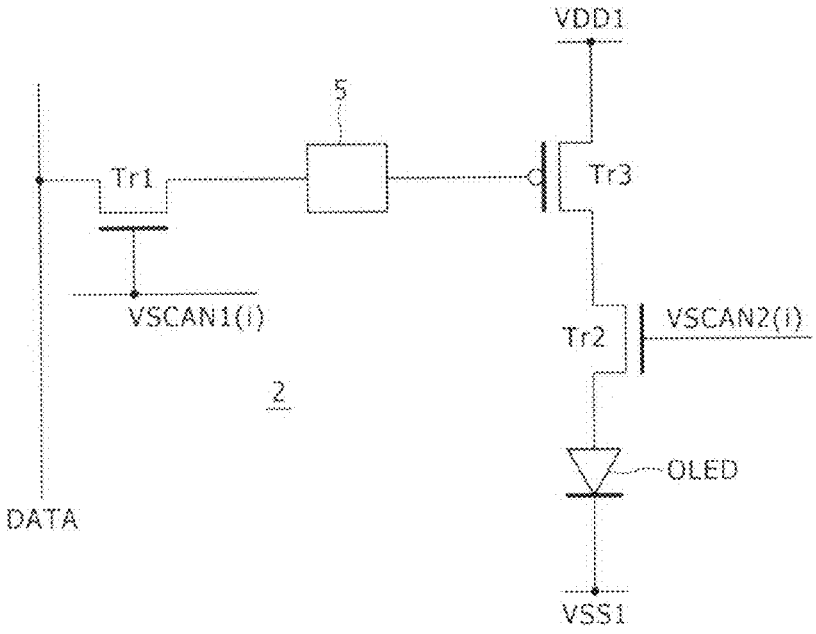
FIG. 2 is a circuit diagram showing an example of a configuration of a pixel included in the image display apparatus shown in FIG. 1.

FIG. 2 shows a circuit configuration of each pixel 2 shown in FIG. 1. Referring to FIG. 2, the pixel circuit shown includes at least a sampling transistor Tr1, a drive transistor Tr3, a switching transistor Tr2, and an electro-optical element which may be an organic EL light emitting element OLED. An additional circuit 5 having a sample hold function and/or a correction function of an ordinary image signal is interposed between the sampling transistor Tr1 and the drive transistor Tr3. It is to be noted that, where the circuit configuration of a pixel 2 is described, it is sometimes referred to as a pixel circuit.

In the circuit configuration shown in FIG. 2, the drive transistor Tr3 is a P-channel transistor and is connected at the source thereof to a power supply line VDD1 and at the drain thereof to the anode of the light emitting element OLED through the switching transistor Tr2. The switching transistor Tr2 is connected at the gate thereof to a second scanning line VSCAN2. Meanwhile, the sampling transistor Tr1 is connected at one terminal thereof to a signal line DATA and at the other terminal thereof to the gate of the drive transistor Tr3 through the additional circuit 5. The sampling transistor Tr1 is connected at the gate thereof to a first scanning line VSCAN1.

The sampling transistor Tr1 is able to conduct in response to a first control signal supplied thereto from the first scanning line VSCAN1(*i*) to sample an image signal (data) supplied thereto from the signal line DATA and hold the sampled image signal (data) into the additional circuit 5. The drive transistor Tr3 supplies output current corresponding to the sampled and held image signal to the light emitting element OLED. The light emitting element OLED is driven by the output current supplied thereto from the drive transistor Tr3 to emit light in luminance according to the image signal. The switching transistor Tr2 is disposed in a current path along which the output current flows, and exhibits an on state within a time width of a second control signal supplied thereto from the second scanning line VSCAN2(*i*) to supply the output current to the light emitting element OLED so that the light emitting element OLED emits light within a light emitting period equal to the time width.

Figure 3:
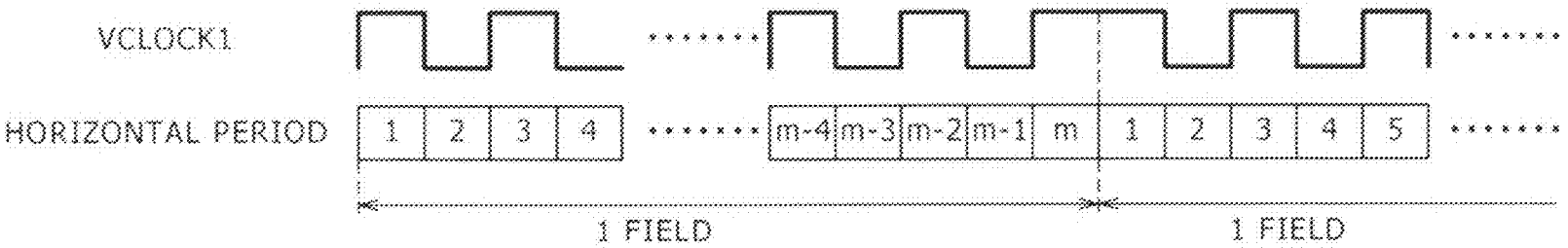
FIG. 3 is a waveform diagram illustrating operation which may be performed by the image display apparatus shown in FIG. 1.

When a displaying operation of a display apparatus is performed in accordance with the raster scanning system, the clock signal which makes a reference to the operation of a V scanner is not always supplied as uniform clocks. One of cases wherein uniform clocks are not supplied is illustrated in FIG. 3. Referring to FIG. 3, in the case illustrated, the clock signal Vclock1 supplied to the first scanner has one period which is equal to two horizontal periods and one field includes an odd number of horizontal periods m. In this instance, the clock signal Vclock1 is not reversed upon changeover between fields. In other words, the clock signal Vclock1 has a waveform which includes normal periods and different periods in a mixed manner. Operation of the V scanner must be performed continuously between a preceding field and a succeeding field. To this end, the clock signal Vclock1 must have the high level at the top of the succeeding field. Therefore, adjustment is performed within the first horizontal period 1 of the succeeding field so that the clock signal Vclock1 is not reversed.

Figure 4:
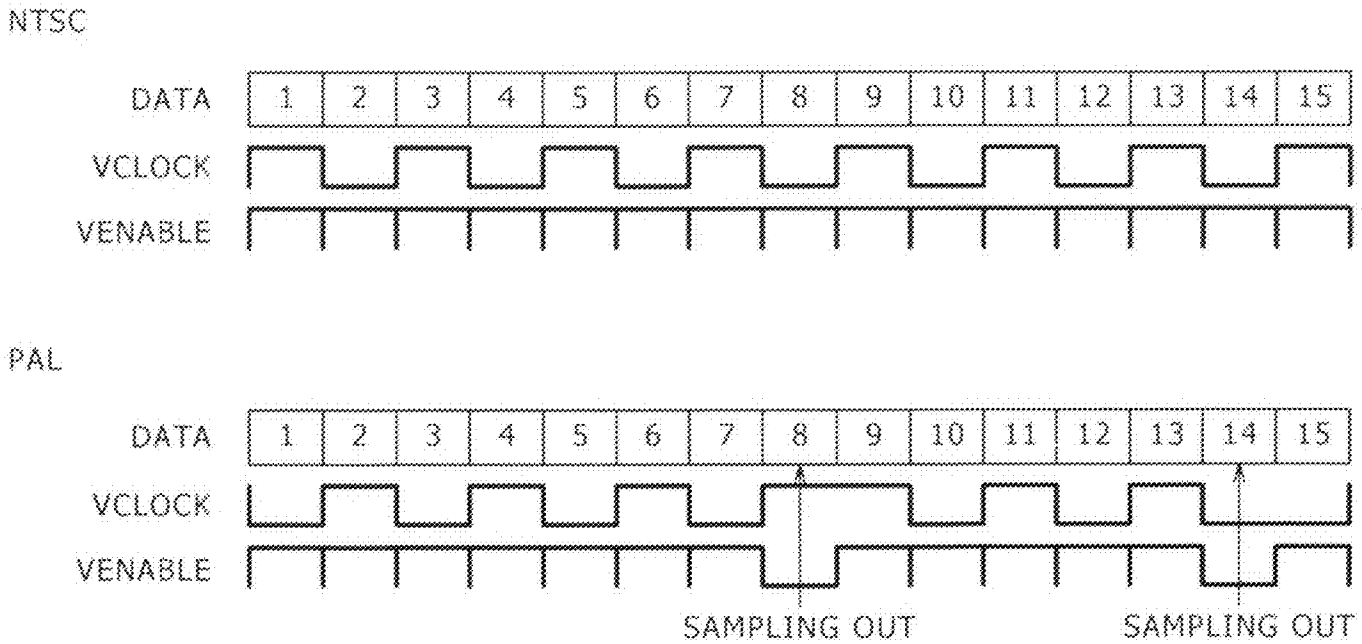
FIG. 4 is a timing chart illustrating operation which may be performed by the image display apparatus shown in FIG. 1.

As another case, a case is applicable wherein image signals having different numbers of scanning lines like those of the NTSC system and the PAL system are displayed on the same display apparatus. The case described is illustrated in FIG. 4. An upper stage of the timing chart of FIG. 4 illustrates an example wherein a display unit fabricated so as to have the number of scanning lines of the NTSC system displays an image signal based on the same NTSC system. In this instance, both of the H driver side and the V scanner side may operate in synchronism with ordinary line sequential scanning. In particular, the H driver side supplies a sequential image signal (data) for each one horizontal period. In FIG. 4, such data are numbered for each line. Meanwhile, the V scanner side may operate in response to an ordinary V clock signal to supply control signals for sequential sampling to the pixel array section side. Venable is a signal for controlling on/off of the output stage of the V scanner, and in the example illustrated in FIG. 4, all of the Venable signals are set as through signals.

A lower stage in FIG. 4 illustrates a case wherein a display apparatus designed so as to have the scanning line number (525) of the NTSC system is used to display an image signal of the PAL system which uses a scanning line number (625) greater than that of the NTSC system. In this instance, a V clock of the V scanner side is stopped while the Venable signal is applied to the V scanner to sample out data. In the example illustrated in FIG. 4, data on the eighth line and data on the 14th line are sampled out. Upon such sampling out, the transfer period of the V clock becomes longer than its ordinary length. Further, the Venable signal is rendered active just when the data of the eighth line are outputted thereby to interrupt the output of the sampling control signal. Consequently, although the data of the eighth line are outputted from the H driver, they are not sampled by the pixel array and consequently are sampled out.

Figure 5:
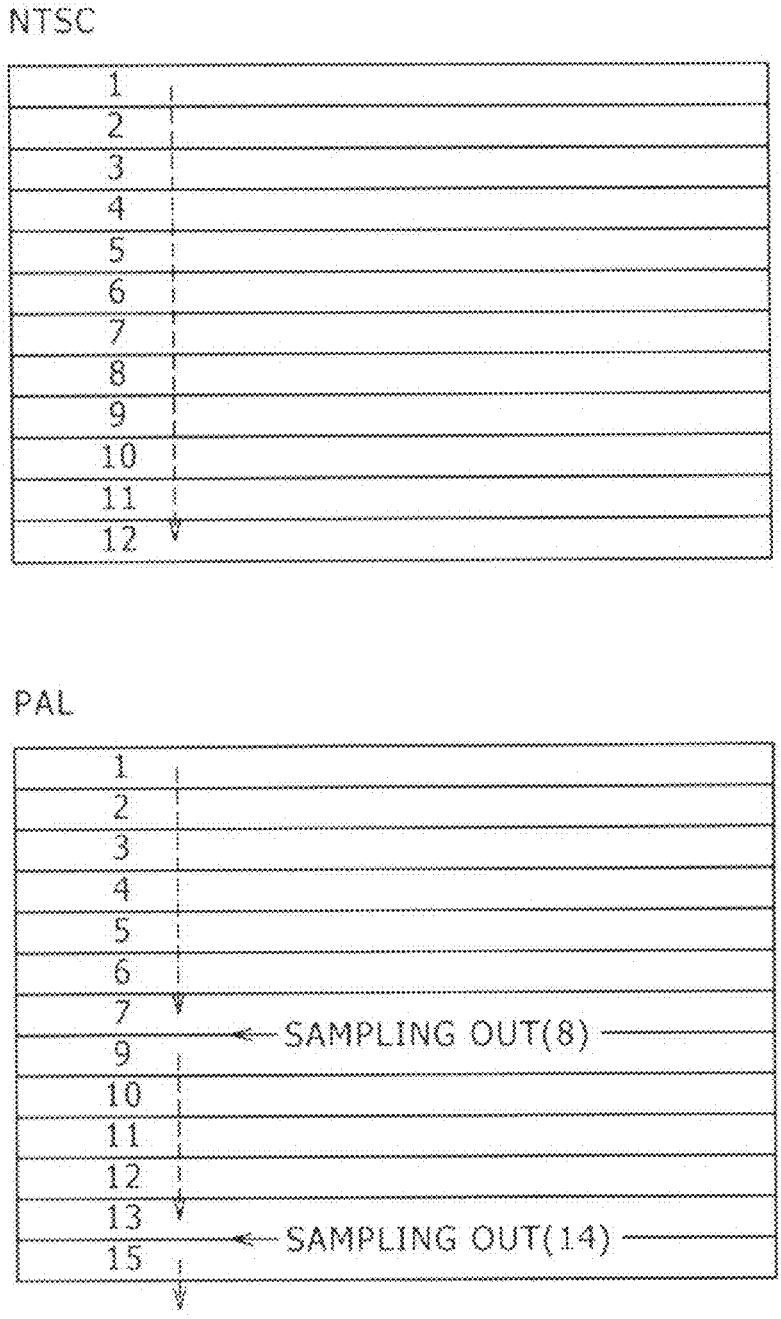
FIG. 5 is a schematic view illustrating operation which may be performed by the image display apparatus shown in FIG. 1.

FIG. 5 illustrates display states of the image display apparatus. An upper stage in FIG. 5 illustrates a display state where an image display apparatus for the NTSC system displays an image signal of the NTSC system. In this instance, data 1, 2, 3, . . . corresponding to the individual lines may be successively written in order from above.

A lower stage in FIG. 5 illustrates another display state wherein an image display apparatus of the NTSC system displays an image signal of the PAL system. In this instance, the line number of the data side is greater than the line number of the device side. Therefore, sampling out scanning of data is performed. For example, although data of the eighths line should normally be written into the pixels of the eighth row from above, they are sampled out and data of the next ninth row are written into the pixels. Similarly, although data of the 14th line should be written into the pixels of the 13th row, they are sampled out and data of the 15th line are written into the pixels. By sampling out data for one line per every 6 to 7 lines in this manner, the PAL image signal can be displayed on the NTSC display apparatus.

As another case, an example is applicable wherein a same input image signal is displayed switchably between ordinary 4:3 display and 16:9 wide display on a display panel of an ordinary aspect ratio of 4:3. Also in this instance, wide display in which the scanning line number of a display image decreases can be implemented by sampling out scanning lines using a method similar to that described above.

Figure 6:
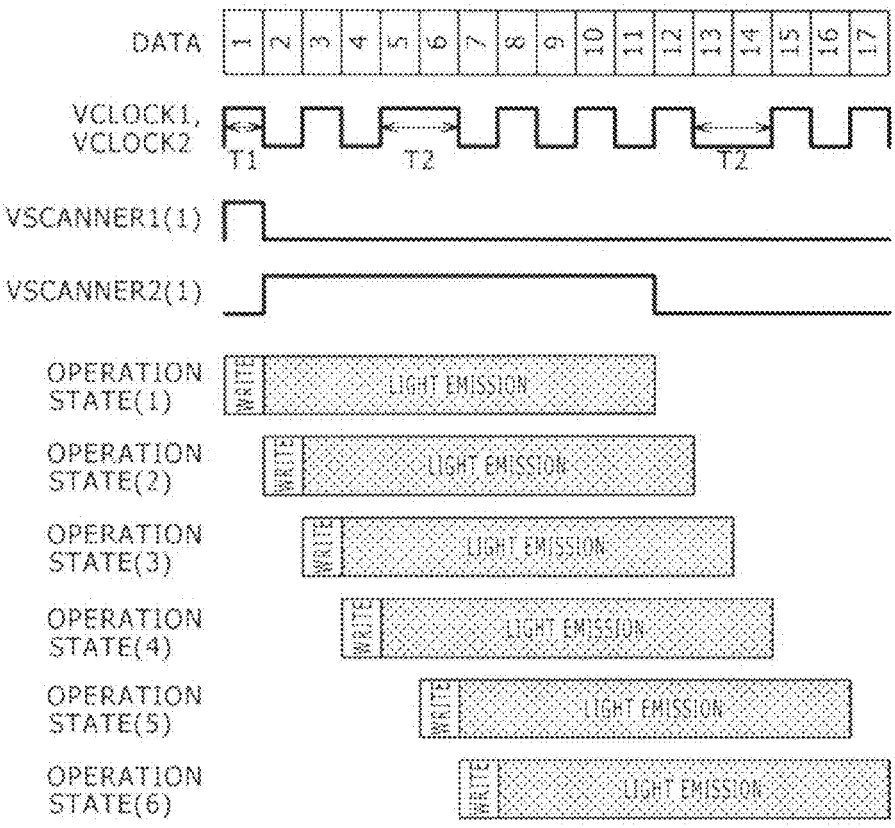
FIG. 6 is a timing chart illustrating different operation which may be performed by the image display apparatus shown in FIG. 1.

FIG. 6 illustrates operation of the image display apparatus shown in FIG. 1 when sampling out scanning is used. It is to be noted, however, that FIG. 6 illustrates operation in a case wherein necessary masking is not applied to the second control signals outputted from the second scanner for the convenience of illustration and description. First, data are successively outputted from the H driver for every horizontal period.

Meanwhile, the clock signals Vclock1 and Vclock2 for operation reference are supplied to the first and second scanners, respectively. In the example illustrated, the same clock is used as the clock signals Vclock1 and Vclock2. However, according to the present invention, this is not essentially required, but it is basically necessary for the clock signals Vclock1 and Vclock2 only to have the same waveform and they may have a fixed phase difference. As seen in FIG. 6, the clock signals Vclock1 and Vclock2 are clock signals which define transfer periods which include ordinary first transfer periods T1 and second transfer periods T2 longer than the first transfer periods T1 and mixed with the first transfer periods T1 within one field.

The first scanner (Vscanner1) operates in accordance with the clock signal Vclock1 to output sequential first control signals. In the timing chart of FIG. 6, the first control signal outputted to the first scanning line for the first line is denoted by Vscanner1(1). The first scanner operates in response to the clock signal Vclock1 to output the first control signal Vscanner1(1) in a successively displayed state to the first scanning lines for the second and succeeding lines. Similarly, also the second scanner operates in response to the clock signal Vclock2 to output a sequential second control signal to the second scanning lines. In the timing chart of FIG. 6, the second control signal outputted to the second scanning line for the first line is denoted by Vscanner2(1). To the scanning lines for the second and succeeding lines, the second control signals of the waveforms obtained by successively displacing the second control signal Vscanner2(1) are supplied individually.

In the timing chart of FIG. 6, operation states of several pixel rows are also illustrated sequentially in conformity with the clock signals Vclock1 and Vclock2. The operation state (1) illustrates an operation state of the pixels of the first row (first line). First, sampling (writing) of the data 1 is performed in response to the first control signal Vscanner1(1), and then, in response to the second control signal Vscanner2(1), the light emitting elements are driven to emit light for a period of time corresponding to the time width of the second control signal Vscanner2(1).

The operation state (2) of the second line similarly includes data writing and light emission. In this instance, the first control signal Vscanner1 is shifted by one stage in response to a falling or rising edge of the clock signal Vclock1. Therefore, in the operation state (2), the data 2 are written. Meanwhile, the second control signal Vscanner2 is shifted at a rising edge thereof rearwardly in response to a falling edge or a rising edge of the clock signal Vclock2 and is similarly shifted at a falling edge thereof rearwardly in response to a rising edge or a falling edge of the clock signal Vclock2. Therefore, in the operation state (2), the light emitting period is shifted rearwardly just by the time period T1.

Thereafter, the operation states (3), . . . follow in a similar manner. It is to be noted, however, that, since, in the operation state (3), a rising edge of the second control signal Vscanner2 falls within the second transfer period T2 of the clock signal Vclock2, it is delayed rearwardly by the time period T2−T1 from its ordinary timing. Therefore, there is a problem that, in the operation state (3), the light emitting period becomes longer by the period T2−T1 when compared with the operation states of the other lines, resulting in different luminance.

In the operation state (4), the clock signal Vclock2 applied in the operation state (3) is shifted rearwardly as it is in the shorter first transfer period T1, the light emitting period becomes longer similarly to that in the operation state (3). Thereafter, in the operation state (5), since a rising edge of the clock signal Vclock2 just falls within the long second transfer period T2 of the clock signal Vclock2, the light emitting starting timing is displaced rearwardly by the period T2−T1. Therefore, the light emitting period in the operation state (5) restores its original condition and becomes the same as that of the operation states (1) and (2).

In this manner, where short first transfer periods T1 and long second transfer periods T2 are included in a mixed manner in the clock signal Vclock2, a difference appears between light emitting periods in different lines. If the time width of the light emitting periods is sufficiently long and close to that of one field, then the difference of the period T2−T1 (one horizontal period) may not substantially matter. For example, if the light emitting period corresponds to 320 horizontal periods and the difference in the light emitting period between lines is one horizontal period, then the luminance difference is approximately 0.3% (=1/320) and can be hardly discerned visually. However, where the number of horizontal periods of the light emitting period is small, the difference makes a significant problem. For example, where the light emitting period corresponds to 10 horizontal periods, if the luminance difference between lines corresponds to one horizontal period, then the luminance difference is 10% (=1/10). Thus, the difference in luminance between lines becomes very conspicuous.

Figure 7:
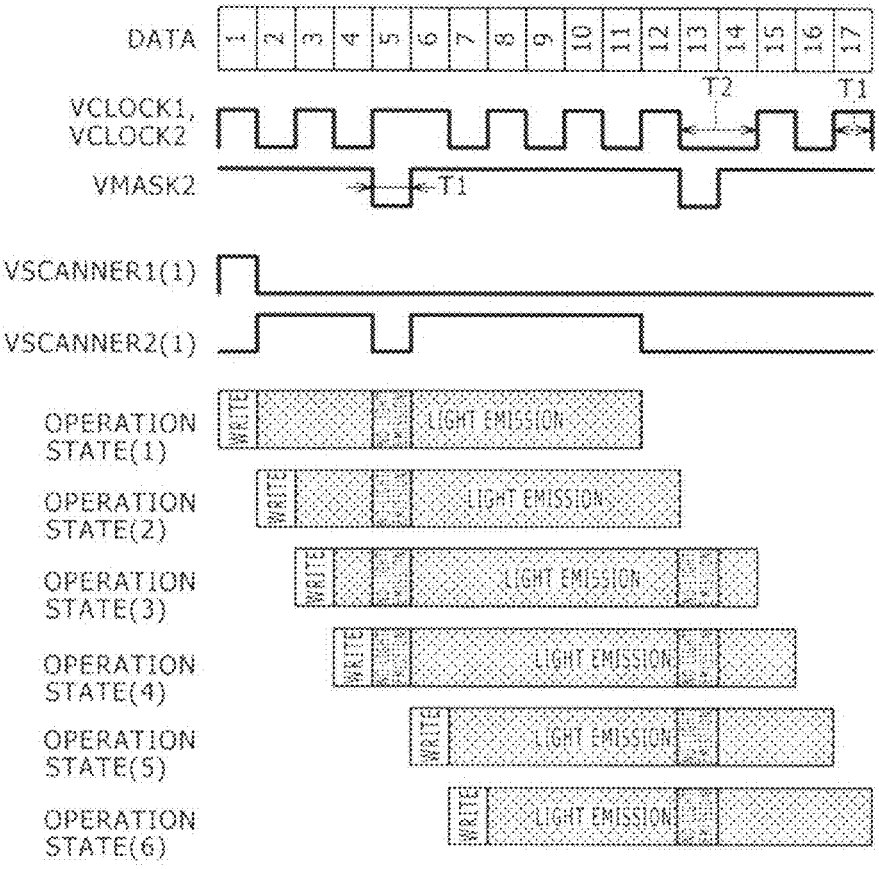
FIG. 7 is a timing chart illustrating a first mode of operation of the image display apparatus shown in FIG. 1.

FIG. 7 illustrates a countermeasure according to the present invention for eliminating the difference in luminance between lines described above. In order to facilitate understanding, the timing chart of FIG. 7 is shown in a manner representation similar to that of FIG. 6. Referring to FIG. 7, according to the countermeasure illustrated, a masking signal Vmask2 is applied to the second control signal Vscanner2 to turn off the output of the second control signals Vscanner2 in conformity with the second transfer period T2 to adjust the light emitting period against a variation caused by the mixture of the second transfer periods T2. In particular, the second scanner logically ANDs the second control signals Vscanner2 (*i*) successively produced in response to the clock signal Vclock2 and the masking signal Vmask2 inputted from the outside in synchronism with the clock signal Vclock2 to turn off the output of the second control signals Vscanner2(*i*). Thus, while the clock signal Vclock2 includes the first transfer periods T1 and the second transfer periods T2 which are longer than the first transfer periods T1, the masking signal Vmask2 should be controlled so that the second control signal Vscanner2 may be off within part of the second transfer period T2. In this instance, in order to adjust the light emitting periods precisely, the off period T1 of the masking signal Vmask2 preferably is equal to T2−T1. However, where the application of masking has a bad influence on the phase relationship to the other circuits, the masking period need not necessarily be precisely equal to T2−T1. In this instance, there is no problem if the masking period is set to a period proximate to T2−T1 such that the error between them is included in a range within which it cannot be visually observed.

Preferably, the timing at which masking is to be applied to the second control signal Vscanner2(*i*) is within a period within which writing of data is not performed. If masking is applied, then because the pixel array section is temporarily placed into a no-light emitting state, potential variation sometimes occurs in the inside of the pixel array section. This potential variation sometimes has an influence on the writing of data. If temporary potential variation caused by masking applied to the second control signal Vscanner2 has a bad influence on data, then there is the possibility that a luminance difference may appear between a pixel row into which data writing is performed at a timing at which masking is applied and another pixel row into which data writing is performed at a timing at which masking is not applied. Therefore, in the present example, each pixel row is temporarily placed into a no-light emitting state at a timing at which data writing into the pixel row is not performed.

In the operation state (1) of the pixel low for the first line, the pixels are controlled to a no-light emitting state for a period of time corresponding to just one horizontal period at a timing at which data writing is not performed. As a result, when compared with the operation state illustrated in FIG. 6, the light emitting period is reduced by one horizontal period. Also in the operation state (2) for the second line, the light emitting period is shorter by one horizontal period. In the next operation state (3), masking is applied twice, and consequently, the light emitting period is shorter by two horizontal periods. As described hereinabove, in the operation state (3), the light emitting period is originally longer by one horizontal period than that in the operation states (1) and (2). Accordingly, by applying masking to reduce the light emitting period by two horizontal periods, the light emitting period can be made equal to that in the operation states (1) and (2). Similarly, also in the operation state (4), the light emitting period is adjusted to that of the other pixel rows by applying masking to the light emitting period twice.

Figure 8:
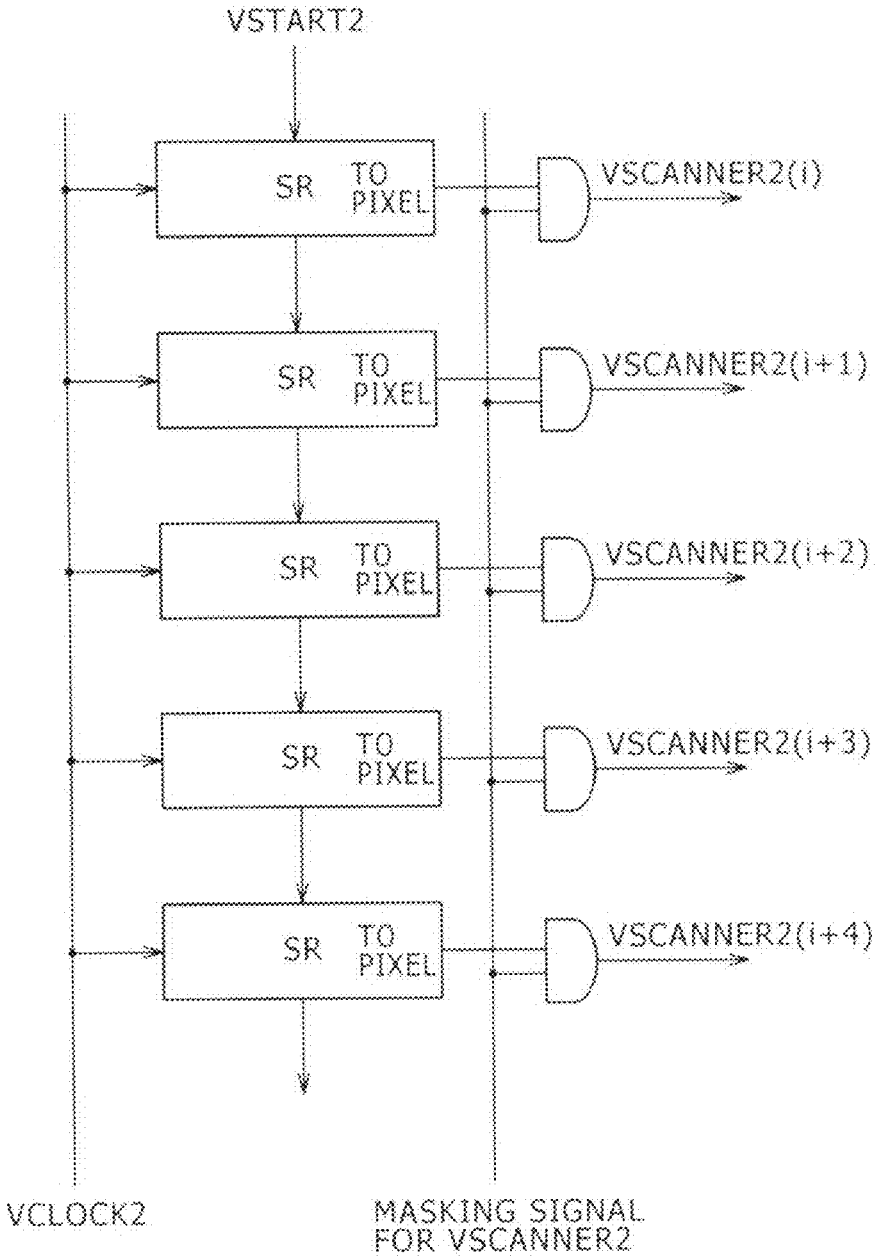
FIG. 8 is a circuit diagram showing an example of a configuration of a second scanner of the image display apparatus shown in FIG. 1 which can perform the operation illustrated in FIG. 7.

FIG. 8 shows an example of a configuration of the second scanner which implements such operation timings as illustrated in FIG. 7. Referring to FIG. 8, the second scanner for controlling the light emitting period includes a plurality of flip-flops SR connected in multi stages to form a shift register. Each of the flip-flops SR operates in response to the clock signal Vclock2 to successively transfer a start pulse Vstart2 so that second control signals Vscanner2(*i*) are outputted from the individual stages or flip-flops SR. In this instance, an AND element is connected to each of the output stages of the shift register such that it logically ANDs a second control signal produced by the shift register side and a masking signal inputted from the outside in synchronism with the clock signal Vclock2.

Figure 9:
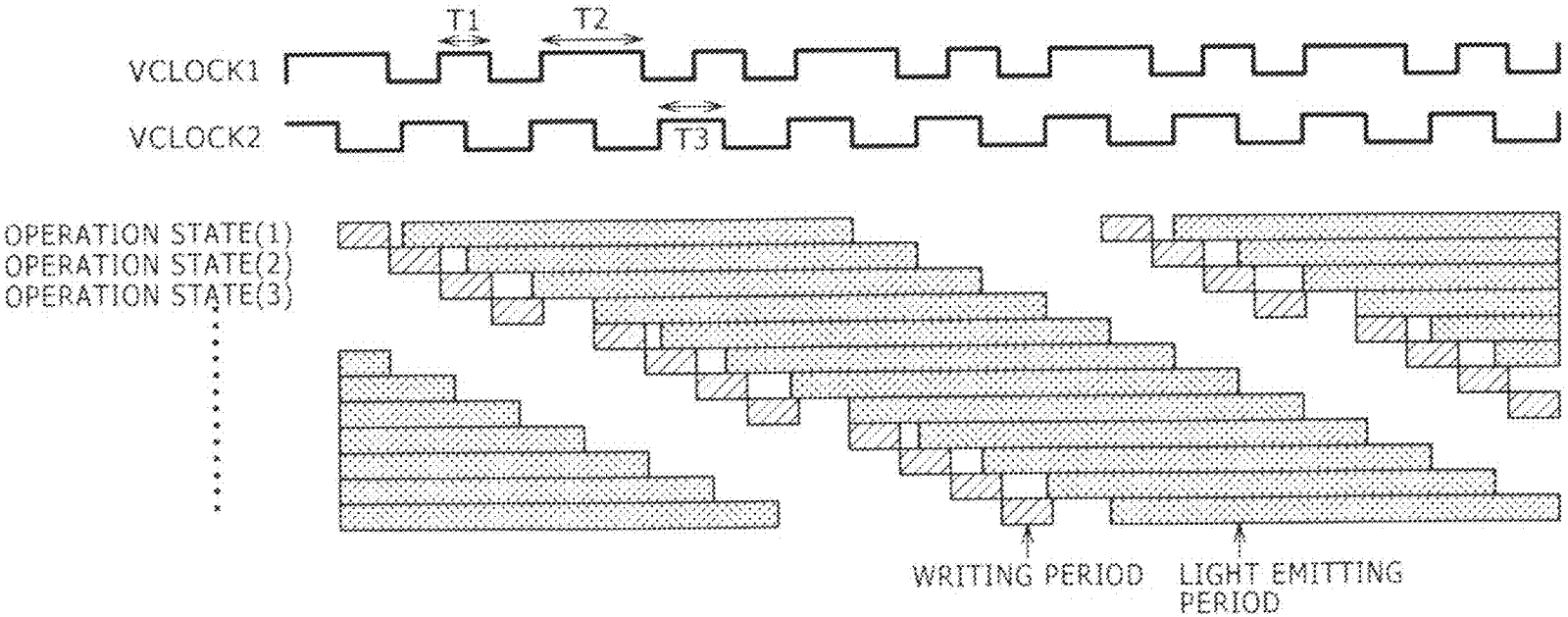
FIG. 9 is a timing chart illustrating a second mode of operation of the image display apparatus shown in FIG. 1.

FIG. 9 illustrates a different manner of operation of the image display apparatus shown in FIG. 1 and particularly shows a waveform of the clock signal Vclock1 inputted to the first scanner 3 and the clock signal Vclock2 inputted to the second scanner 4. In addition, FIG. 9 illustrates the operation states (1), (2), (3), . . . of the pixels of the rows of the pixel array section 1. The first scanner operates in response to the first clock signal Vclock1 which defines the transfer periods in which the ordinary first transfer periods T1 and the second transfer periods T2 which are longer than the first transfer periods T1 are mixed within one field to control the data writing operation of the pixels of the lines. Meanwhile, the second scanner operates in response to the second clock signal Vclock2 which is not in synchronism with the first clock signal Vclock1 and defines a third transfer period T3 which is different from the first transfer period T1 and the second transfer period T2 to control the light emitting operation of the pixel columns of the lines.

The operation state (1) of the pixel row for the first line includes a writing period and a light emitting period within one field. Thereafter, the operation states (2), (3), . . . for the second and succeeding lines follow while the writing period and the light emitting period are successively shifted rearwardly in response to the clock signals Vclock1 and Vclock2, respectively. As apparently seen from the timing chart, the writing periods and the light emitting periods of the lines are asynchronous. In other words, the light emitting period for each line can be assured so as to always have a fixed time width without being influenced by the writing period. In this instance, preferably the third transfer period T3 of the second control signal defined by the clock signal Vclock2 is fixed. Where the third transfer period T3 is fixed, the light emitting period is fixed among the lines. Preferably, the transfer period of the second control signal Vscanner2 which is determined by the clock signal Vclock2 is equal to an average period in a field of a transfer period of the first control signal Vscanner1 which is determined by the clock signal Vclock1. By such setting as just described, although the writing period and the light emitting period are asynchronous among the lines, they are synchronous in a unit of a field as seen from the timing chart. It is to be noted, however, that, depending upon the clock used in the driving system of the image display apparatus, the relationship between the clock signals Vclock1 and Vclock2 illustrated in FIG. 9 may not necessarily be set accurately. In such a case, the third transfer period T3 of the clock signal Vclock2 may be varied for each scanning line within a range within which a luminance difference caused by light emitting periods cannot be visually recognized. Where the period of the clock signals Vclock1 and Vclock2 is controlled in such a manner as described above, even if sampling out scanning or changeover between normal display and wide display is performed, an image of high quality, free from a luminance difference between different lines, can be displayed.

Figure 10:
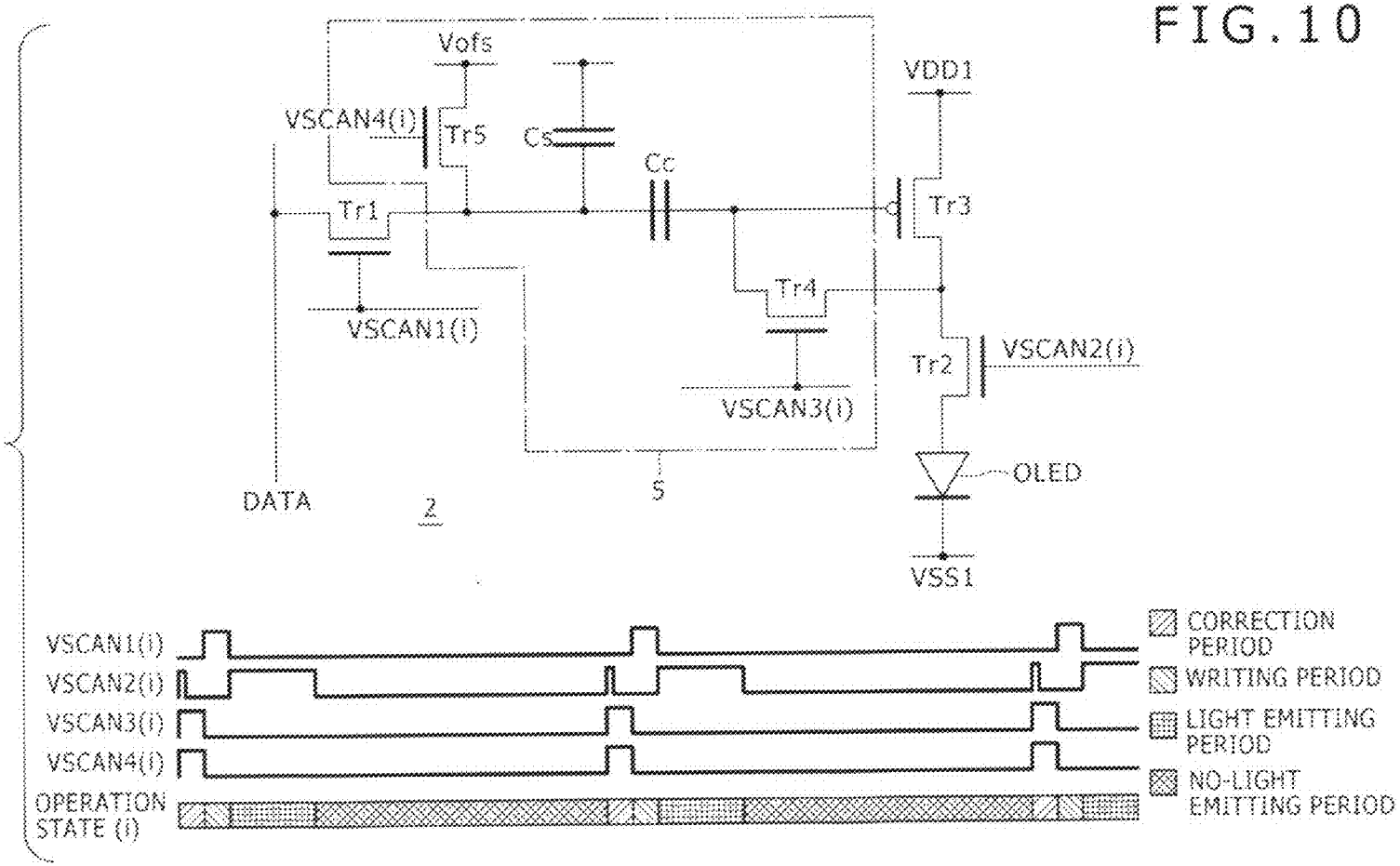
FIG. 10 is a circuit diagram and a timing chart illustrating an example of a particular configuration of the pixel shown in FIG. 2 and operation of the pixel, respectively.

FIG. 10 shows an example of a particular configuration of the pixel circuit shown in FIG. 2. Referring to FIG. 10, the additional circuit 5 is interposed between the drive transistor Tr3 and the sampling transistor Tr1. The additional circuit 5 includes a pixel capacitor Cs, a coupling capacitor Cc, and correcting transistors Tr4 and Tr5. The coupling capacitor Cc couples one terminal of the sampling transistor Tr1 to the gate of the drive transistor Tr3. The correcting transistor Tr4 is interposed between the gate and the drain of the drive transistor Tr3 and controlled by the third scanning line VSCAN3(*i*). The correcting transistor Tr5 is connected to a predetermined offset potential Vofs and one terminal of the coupling capacitor Cc and is connected at the gate thereof to a fourth scanning line VSCAN4(*i*).

At a lower stage in FIG. 10, a timing chart is shown which illustrates operation of the pixel 2 described hereinabove. The timing chart illustrates waveforms of control signals applied to the scanning line VSCAN1(*i*) connected to the gate of the sampling transistor Tr1, the scanning line VSCAN2(*i*) connected to the switching transistor Tr2 which performs light emission control, the scanning line VSCAN3(*i*) connected to the gate of the correcting transistor Tr4 and the scanning line VSCAN4(*i*) connected to the gate, of the correcting transistor Tr5. Simultaneously, the driving state of the pixel row for the ith line is also illustrated. In the driving state (i) illustrated, dispersion correction of the threshold voltage of the drive transistor Tr3 is performed within a correction period, and then writing of an image signal is performed within a next writing period. Thereafter, the light emitting element OLED is driven to emit light within a light emitting period, and then the light emission is stopped within the remaining no-light emitting period. In order to perform such a sequence of operations as just described, it is necessary for the second to fourth control signals (VSCAN2, VSCAN3 and VSCAN4) to be in synchronism with each other as seen from the timing chart. On the other hand, the first control signal (VSCAN1) need not be in synchronism with the other control signals. Within the correction period, the switching transistor Tr2 is turned on, and then the correcting transistors Tr4 and Tr5 are turned on simultaneously to detect and write the threshold voltage of the drive transistor Tr3 into the pixel capacitor Cs. The threshold voltage 4 can be canceled by applying a voltage corresponding to the detected threshold voltage to the drive transistor Tr3. In order to perform this correction operation, it is necessary to synthesize the control signals VSCAN2, VSCAN3 and VSCAN4 with each other. Thereafter, an operation of writing the image signal into the pixel capacitor Cs and the light emitting operation of turning on the light emitting element are performed. The writing operation may be placed between the correction operation and the light emitting operation and does not require precise synchronism adjustment. Therefore, there is no necessity to precisely synchronize the first scanning line VSCAN1 with the other control signals VSCAN2, VSCAN3 and VSCAN4.

Figure 11:
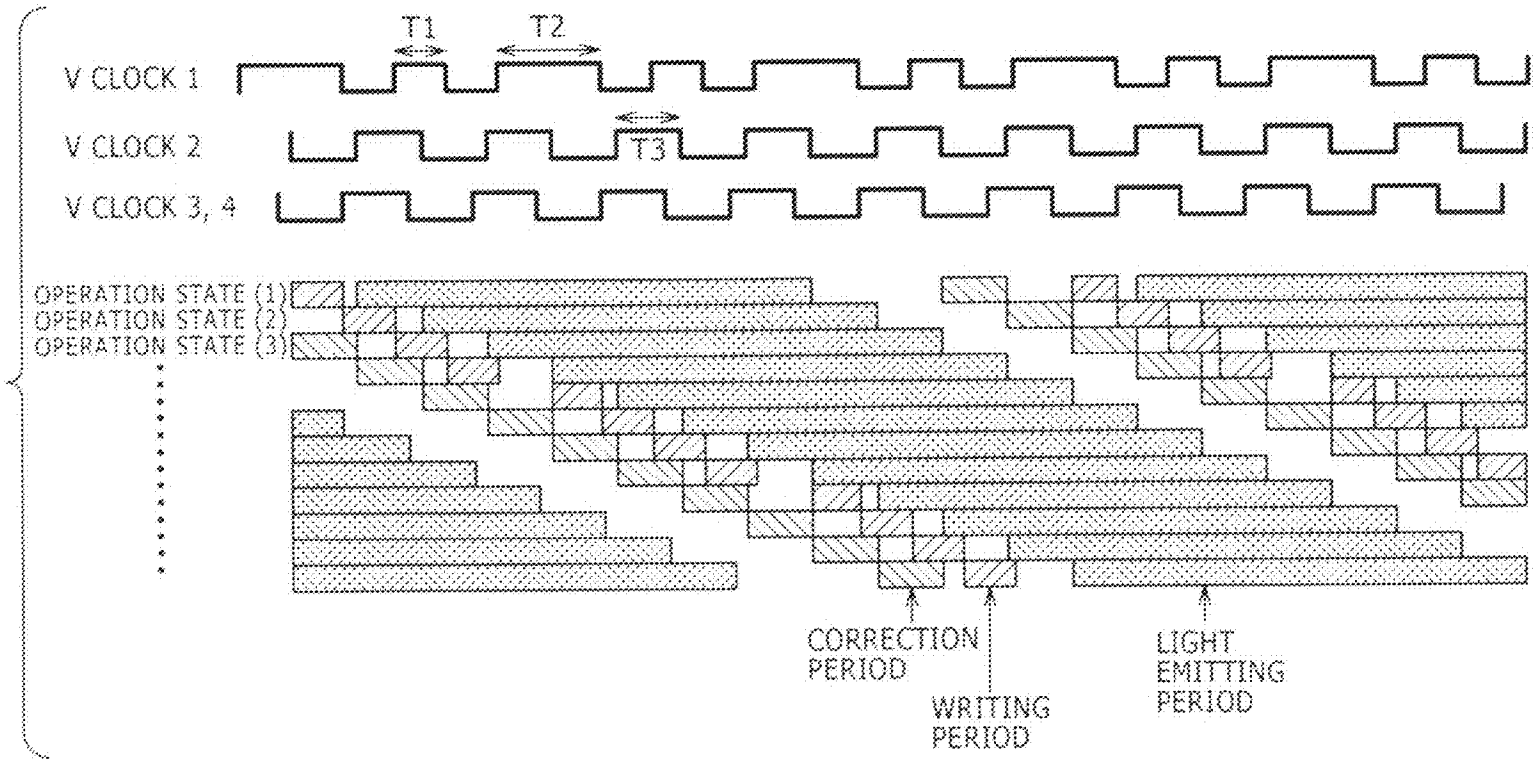
FIG. 11 is a waveform diagram illustrating operation of the pixel shown in FIG. 10.

FIG. 11 illustrates clock signal waveforms applied to the scanners of the image display apparatus which incorporates the pixel 2 shown in FIG. 10. Since it is necessary to synchronize the control signals VSCAN2, VSCAN3 and VSCAN4 with each other as described hereinabove, the clock signal Vclock2 has a waveform the same as those of the clock signals Vclock3 and Vclock4. However, their phases are shifted relative to each other. On the other hand, the clock signal Vclock1 has a waveform different from that of the other control signals VSCAN2, VSCAN3 and VSCAN4 and includes short periods and long periods. This is necessary for sampling out scanning and changeover between normal display and wide display.

At a lower stage of FIG. 11, operation states (1), (2), (3), . . . of the lines are illustrated. For all of the lines, a correction period is placed first and is followed by a writing period, which is in turn followed by a light emitting period. The writing period may be placed between the correction period and the light emitting period and does not require precise synchronism adjustment.

Figure 12:
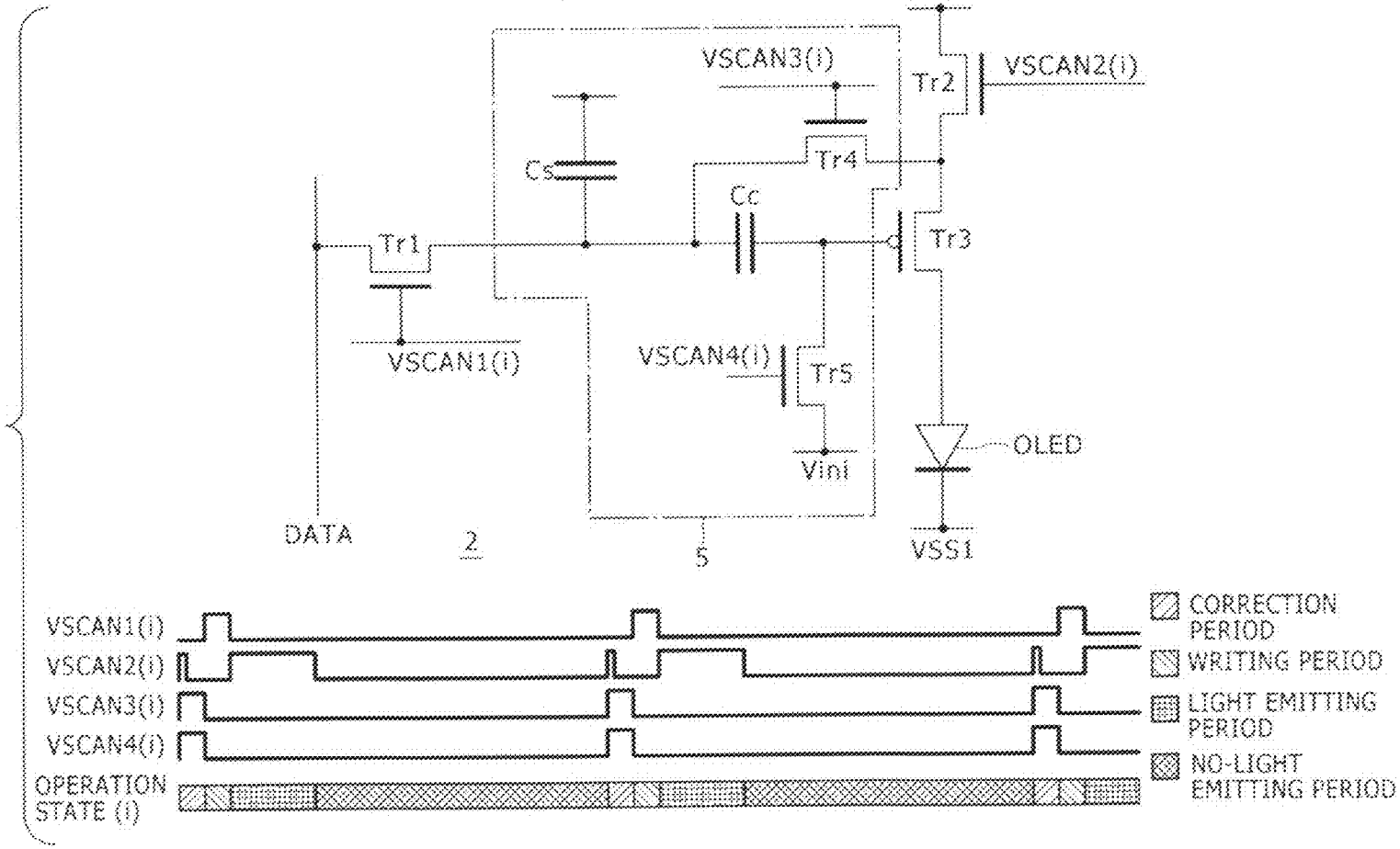
FIG. 12 is a circuit diagram and a timing chart illustrating another example of a particular configuration of the pixel shown in FIG. 2 and operation of the pixel, respectively.

FIG. 12 shows another particular example of the pixel circuit. Referring to FIG. 12, the pixel 2 shown is a modification to the pixel 2 shown in FIG. 10. In particular, in the present pixel 2, the additional circuit 5 is also interposed between the sampling transistor Tr1 and the drive transistor Tr3. Also this additional circuit 5 has a threshold voltage correction function for the drive transistor Tr3. The additional circuit 5 includes a coupling capacitor Cc, a pixel capacitor Cs, and two correcting transistors Tr4 and Tr5. The correcting transistor Tr4 is connected at the gate thereof to the third scanning line VSCAN3(*i*). The correcting transistor Tr5 is connected at the gate thereof to the fourth scanning line VSCAN4(*i*).

A timing chart illustrating operation of the present pixel 2 is shown at a lower stage in FIG. 12. The timing chart illustrates control signals applied to the scanning lines VSCAN1(*i*) to VSCAN4(*i*) and a driving state of a pixel row for the line i. The driving state includes, similar to the driving states described hereinabove with reference to FIG. 10, a correction period at the top thereof. The correction period is followed by a writing period, which is in turn followed by a light emitting period and a no-light emitting period. Within the correction period, it is necessary to apply control signals synchronized with each other to the scanning lines VSCAN2(*i*), VSCAN3(*i*) and VSCAN4(*i*) in order to cancel a dispersion of the threshold voltage of the drive transistor Tr3. Within the succeeding writing period, a control signal for sampling is applied to the first scanning line VSCAN1(*i*). This control signal need not be synchronized with the other control signals. Thereafter, the control signal to be applied to the second scanning line VSCAN2(*i*) is placed back into an on state, by which the light emitting period is entered. In this manner, also in the present pixel 2, the clock signal Vclock1 need not be synchronized with the other clock signals Vclock2, Vclock3 and Vclock4 although it is necessary to synchronize the clock signal Vclock2 and the clock signals Vclock3 and Vclock4 with each other.

Figure 13:
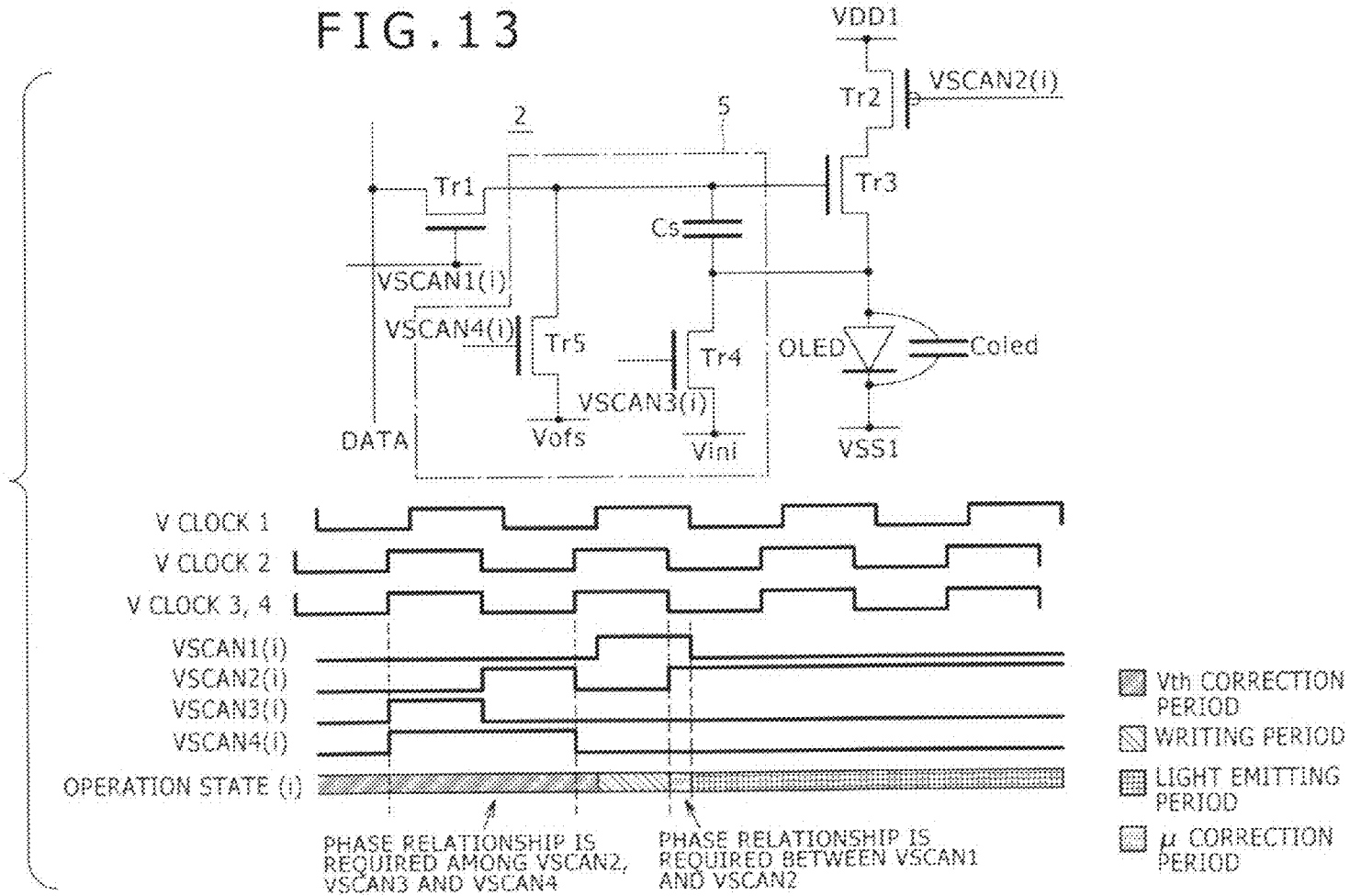
FIG. 13 is a circuit diagram and a timing chart illustrating a further example of a particular configuration of the pixel shown in FIG. 2 and operation of the pixel, respectively.

FIG. 13 shows a further configuration example of the pixel 2. Referring to FIG. 13, the pixel 2 shown is a modification to the pixel 2 described hereinabove with reference to FIG. 10. In particular, the additional circuit 5 is interposed between the sampling transistor Tr1 and the drive transistor Tr3. The additional circuit 5 includes a pixel capacitor Cs connected between the gate and the source of the drive transistor Tr3, a correcting transistor Tr4 connected between the source of the drive transistor Tr3 and an initialization potential Vini, and a correcting transistor Tr5 connected between the gate of the drive transistor Tr3 and a predetermined offset potential Vofs. The correcting transistor Tr4 is connected at the gate thereof to the third scanning line VSCAN3(*i*). The correcting transistor Tr5 is connected at the gate thereof to the fourth scanning line VSCAN4(*i*).

A timing chart is shown at a lower stage in FIG. 13 and illustrates an ordinary operation state wherein no sampling out scanning is performed particularly. In this instance, clock signals VCLOCK1, VCLOCK2, VCLOCK3 and VCLOCK4 having the same waveform and having phases which are shifted relative to each other as occasion demands are supplied to all scanners. In response to the clock signals, such first to fourth control signals as illustrated in the timing chart are applied to the scanning lines VSCAN1(*i*) to VSCAN4(*i*), respectively.

A driving state of the pixel row for the line i is illustrated at the lowest portion of the timing chart. In the first correction period, a sequential control pulse is applied to the scanning lines VSCAN3(*i*), VSCAN4(*i*) and VSCAN2(*i*) so that the threshold voltage of the drive transistor Tr3 is detected and retained into the pixel capacitor Cs. In this correction operation, a phase relationship among the control signals VSCAN2, VSCAN3 and VSCAN4 is required. Thereafter, a writing period within which the first control signal is applied to the first scanning line VSCAN1 is entered. However, in the present case, mobility correction is performed at the last portion. The mobility correction is performed such that, in a state wherein a sampled image signal is applied to the drive transistor Tr3, the switching transistor Tr2 is placed into an on state once so that output current flows so as to be negatively fed back to the pixel capacitor Cs. As the mobility increases, the negative feedback amount increases and a dispersion in mobility p of the drive transistor Tr3 can be canceled. In the p correction period, a phase relationship between the scanning lines VSCAN1 and VSCAN2 is required. As apparent from the foregoing description, according to the present pixel 2, it is necessary to synchronize the control signals VSCAN2, VSCAN3 and VSCAN4 or synchronize the scanning lines VSCAN1 and VSCAN2 depending upon the contents of the operation.

In the pixel 2 of FIG. 13, since sampling out scanning is not performed particularly, the same waveform may be used for all of the clock signals Vclock1 to Vclock4. Accordingly, there is no necessity to particularly pay attention to the phase relationship among the scanning signals VSCAN1 to VSCAN4.

Figure 14:
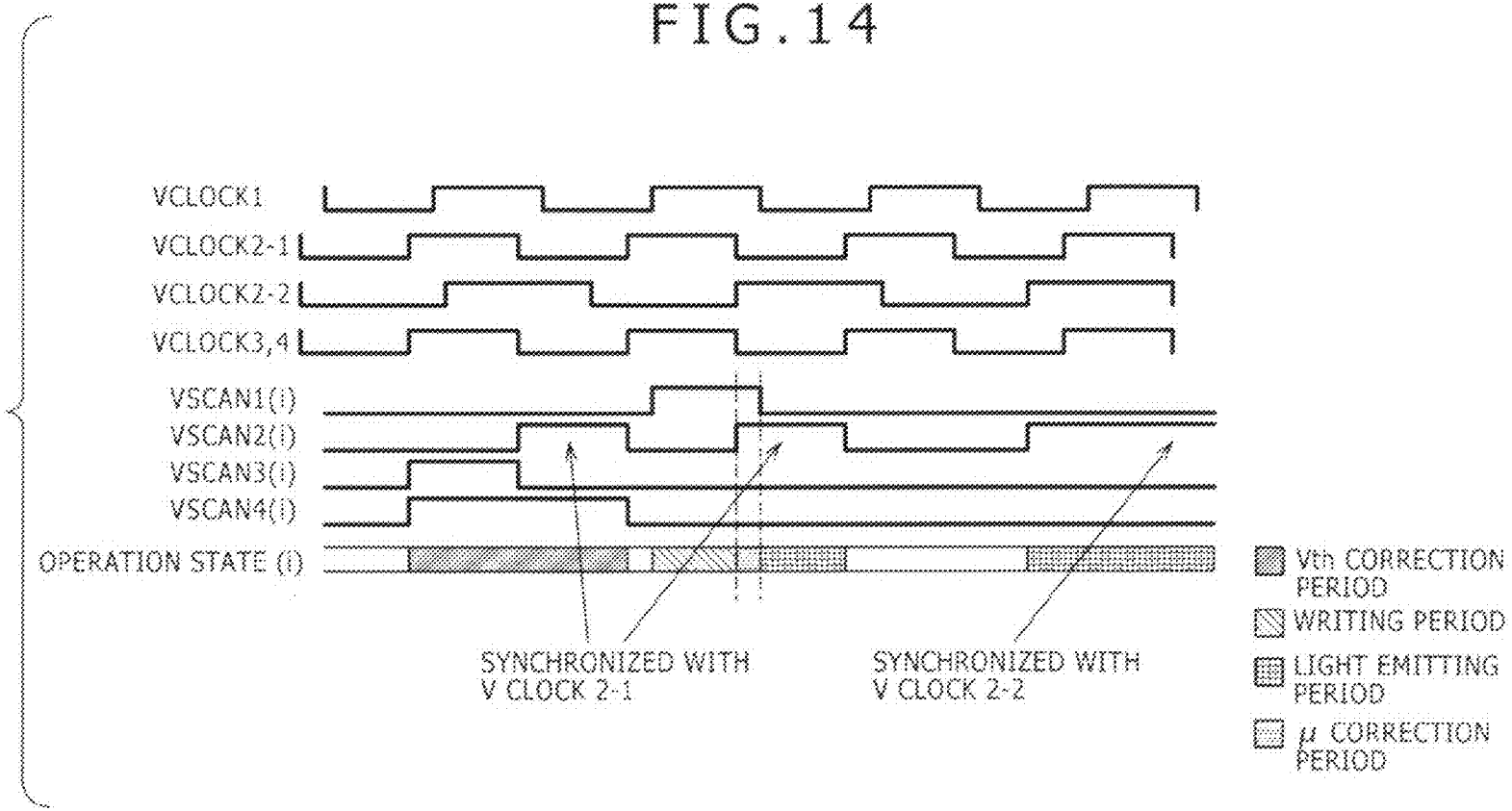
FIG. 14 is a waveform diagram illustrating different operation of the pixel shown in FIG. 13.

FIG. 14 illustrates operation of the pixel 2 shown in FIG. 13 where sampling out scanning is performed. In order to perform sampling out scanning, it is necessary for the clock signals Vclock1 and Vclock2 to have asynchronous different waveforms from each other within a light emitting period. On the other hand, within a Vth correction period or a μ correction period, it is necessary for the clock signals Vclock1 and Vclock2 to have the same waveform and have a fixed phase relationship. Therefore, in the operation of FIG. 14, the clock signal Vclock2 is divided into a clock signal Vclock2-1 and another clock signal Vclock2-2, which are used separately within a correction period and a light emitting period. Within the correction period and the writing period, the same waveform is used for the clock signals Vclock1, Vclock2-1, Vclock3 and Vclock4 so as to keep a phase relationship among them. On the other hand, within the light emitting period, the clock signal Vclock2-2 is used to control the light emitting period so that no influence is had from the other clocks. By this, a dispersion in luminance among the lines is prevented.

Figure 15:
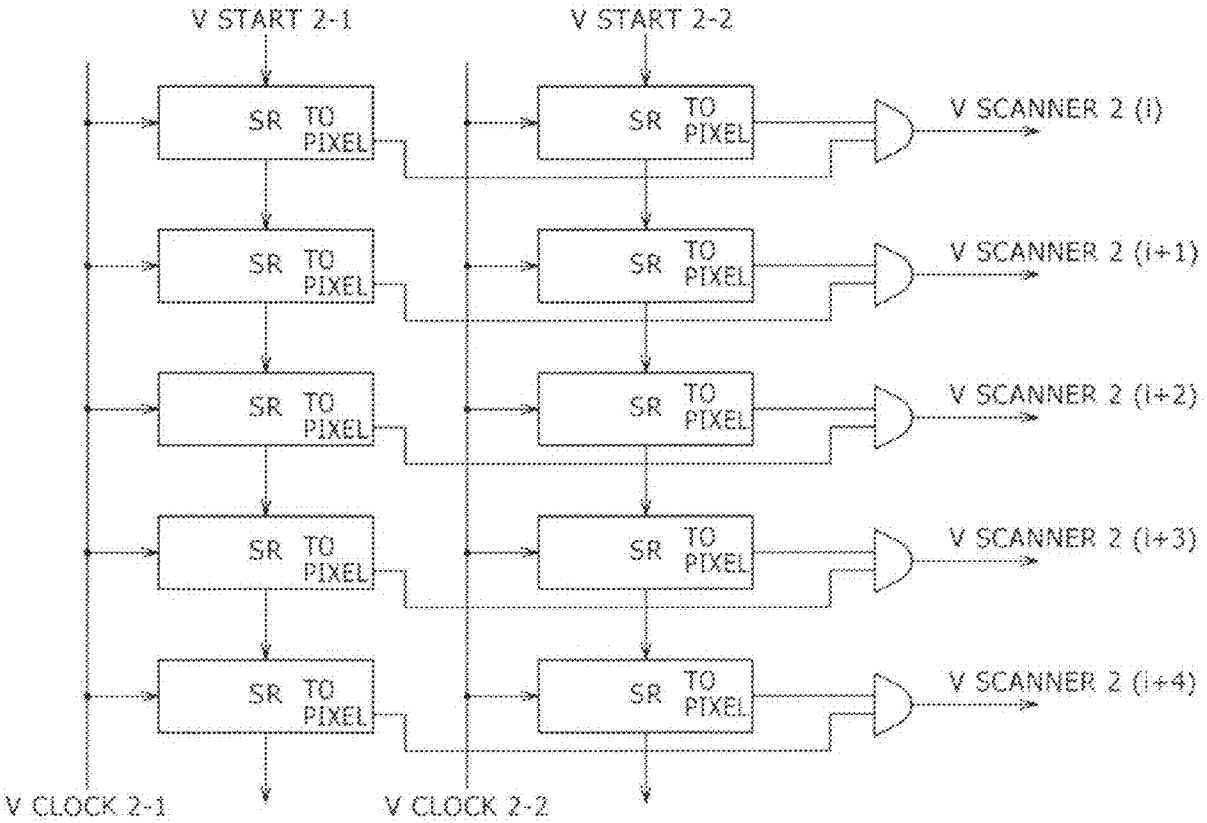
FIGS. 15 and 16 are circuit diagrams showing different examples of a configuration of the second scanner of the image display apparatus shown in FIG. 1.

FIG. 15 shows a configuration of the second scanner (vscanner2) for implementing the operation described above with reference to FIG. 14. Referring to FIG. 15, the second scanner shown includes two shift registers including a shift register which operates in response to the clock signal Vclock2-1 and another shift register which operates in response to the clock signal Vclock2-2. The first shift register successively transfers a start pulse Vstart2-1, based on which signals for controlling the correction period are produced, in response to the clock signal Vclock2-1 so that control signals are outputted from the individual stages of the shift register. The control signals are outputted to OR circuits provided individually for the stages. The second shift register successively transfers a start pulse Vstart2-2, which defines the light emitting period, in response to another start pulse Vstart2-2 so that control signals are outputted similarly to the OR circuits provided individually for the stages. The OR circuits at the individual stages logically OR the control signals outputted from the first shift register and the control signals outputted from the second shift register, and output the resulting second control signals Vscanner2(*i*) to the second scanning lines of the pixel array side.

Incidentally, in the operation of the pixel 2 described hereinabove with reference to FIG. 7, in order to prevent ununiformity of the light emitting time caused by ununiform clock signals, a masking signal is applied to the output of the second control signal to be outputted from the second scanner. If the time width of the masking signal Vmask2 is set to T2−T1 as described hereinabove with reference to FIG. 7, then the light emitting period becomes uniform among all scanning lines while a luminance difference between lines is eliminated.

However, according to operation of the pixel 2 described hereinabove with reference to FIG. 7, such secondary effects as described below sometimes occur. One of the secondary effects is that, since a masking signal is used, the light emitting period of the display apparatus decreases, resulting in a problem that the screen luminance decreases. Another of the secondary effects is that, since the current load flowing through each light emitting element included in the pixel array section varies suddenly as a result of the application of a masking signal, power supply noise is likely to be produced.

It is considered here that, for example, an image signal based on the NTSC system is displayed on a display apparatus whose scanning line number is 240, or in other words, in which 240 horizontal periods are included in one field or one frame. Where the display apparatus uses a light emitting element as a pixel, it is frequently configured such that the ratio of the light emitting period in one field can be adjusted in order to adjust the screen luminance. In particular, the duty ratio of a control signal to be outputted from the second scanner, that is, the ratio of a period of time within which a control signal is on within one field, can be adjusted to control the screen luminance. For example, the light emitting period is set to 220 horizontal periods in the maximum, and the remaining 20 horizontal periods are included in the no-light emitting period. The image signal of the NTSC system does not require application of masking to the control signal to be outputted from the second scanner.

If an image signal of the PAL system is inputted to the display apparatus described above, then in order to display the entire screen of the PAL system on the display apparatus, an amount of data corresponding to one seventh of the scanning line number is sampled out this instance, the ratio of the period of time within which the output of the second scanner is masked is once per seven horizontal periods (1/7) as described hereinabove. Accordingly, the light emitting period is 220×6/7 in the maximum duty, and therefore, the screen luminance decreases to 6/7.

Further, when the masking signal rises, a light emitting element is placed into a no-light emitting state, and then when the masking signal falls (turns off), the light emitting element emits light again. Therefore, when the masking signal turns off, all of the light emitting elements on the entire screen are changed over from a no-light emitting state to a light emitting state. When no masking signal is applied, since turning on/off of the light emitting elements is performed in order for the individual scanning lines, current load variation of the power supply does not matter very much. Accordingly, if a masking signal is applied, then the current load variation of the power supply becomes very great since the light emitting elements are turned on/off over the entire screen.

In summary, first, there is a problem of a luminance difference caused by a light emitting time difference before instruction of a masking signal. Second, there is another problem of decrease of the screen luminance (peak luminance) by introduction of a masking signal. Third, there is a further problem of power supply load variation by introduction of a masking signal. Since the first to third problems relate to one another, the degree of importance of them varies depending upon whether the light emitting period is long (the screen luminance is high) or short (the screen luminance is low).

It is assumed first that the light emitting period is long, that is, the screen luminance is high. For example, it is assumed that, in the example described hereinabove, the light emitting period is set to 220 horizontal periods. In this instance, the first problem, that is, the problem of the luminance difference by the light emitting time difference where no masking is applied, does not matter. This is because, since no masking is applied, even if the light emitting period varies by one horizontal scanning period between scanning lines, the luminance difference is 1/220 and less than 0.5% and hence can be little recognized visually. On the other hand, the second problem, that is, the problem of reduction of the peak luminance by introduction of masking, is significant because the application of masking decreases the luminance to 6/7 (less than 86%) and the influence of the decrease is significant. Also the third problem is very significant because, when the light emitting period is long, because the area over which light is emitted at a certain instant within the screen is great, the current load variation when the masking signal falls to allow the light emitting elements to be turned on to emit light is very great.

Now, it is assumed that the light emitting period is short and the screen luminance is low. Further, it is assumed that the light emitting period is set to 10 horizontal periods. In this instance, as regards the first problem, if the light emitting period is different by one horizontal period between scanning lines while masking is not applied, then the luminance variation is 1/10=10% and makes a significant problem. On the other hand, as regards the second problem, although the screen luminance decreases to 6/7, since the light emitting period is originally set short in order to lower the screen luminance, such reduction of the luminance does not matter. In addition, also it is possible to adjust the luminance on the signal level side. Also as regards the third problem, because, where the light emitting period is short, the area over which light is emitted at a certain point of time within the screen is small, it can be recognized that the current load variation when the masking signal is canceled to allow the light emitting elements to be driven to emit light again is smaller than that where the light emitting period is long.

Therefore, in the pixel 2 described hereinabove with reference to FIG. 17, the output off period or masking period within which the output of the second control signal is kept off is set short where the light emitting period is long, but conversely the masking period is set long where the light emitting period is short. This makes it possible to prevent a luminance difference from appearing between scanning lines while the influence of reduction of the screen luminance or of the power supply load variation is moderated. Where the configuration of the present pixel 2 is adopted, high quality display of a high luminance free from a luminance difference can be achieved on an image display apparatus which displays signals of different scanning line numbers on the same panel or has a function of changing over the same signal between normal display of an aspect ratio of 4:3 and wide display of another aspect ratio of 16:9. Further, an image display apparatus can be implemented in which the current load variation of the power supply is small and which can be driven using a simple power supply circuit.

Figure 16:
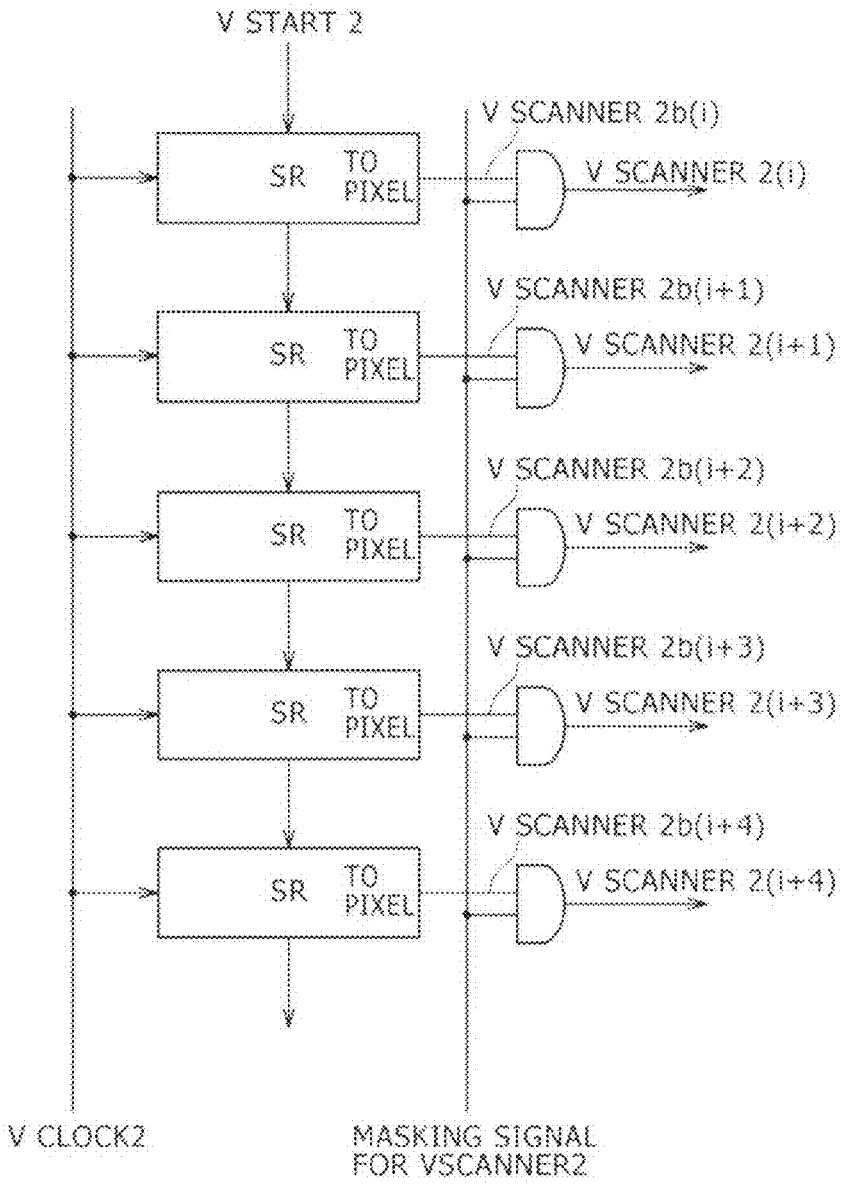

FIG. 16 shows an example of a configuration of the second scanner described hereinabove. Referring to FIG. 16, the second scanner for controlling the light emitting period includes a shift register having multiple register stages SR. The shift register operates in response to a clock signal Vclock2 to successively transfer a start pulse Vstart2 so that second control signals Vscanner2*b*(*i*) are outputted from the individual stages. Here, an AND element is connected to each of the output stages of the shift register such that it logically ANDs a second control signal Vscanner2*b*(*i*) produced by the shift register side and a masking signal inputted from the outside in synchronism with the clock signal Vclock2 to obtain a final second control signal Vscanner2(*i*). In FIG. 16, a control signal before masked is represented by Vscanner2*b*(*i*) while a control signal after masked is represented by Vscanner2(*i*) so as to distinguish them from each other.

The second scanner shown in FIG. 16 changes the output off period or masking period, within which the output of the second control signal Vscanner2(*i*) is to be kept in an off stage in response to the second transfer period (T2), in response to the light emitting period which depends upon the time width of the second control signal Vscanner2(*i*). In particular, the second scanner variably controls the output off period or masking period so as to decrease as the light emitting period increases. For example, the second scanner can change the time width of the second control signal Vscanner2*b*(*i*) to variably adjust the light emitting period within a range from a minimum light emitting period (for example, 10 horizontal periods) to a maximum light emitting period (for example, 220 horizontal periods) within one field. In this instance, the second scanner controls the time width of the second control signal Vscanner2*b*(*i*) so that, when the light emitting period is the maximum light emitting period, the output off period or masking period is equal to the difference between the first transfer period T1 and the second transfer period T2 which is longer than the first transfer period T1. Further, the second scanner controls the time width of the second control signal Vscanner2*b*(*i*) so that, when the light emitting period is the maximum light emitting period, the output off period or masking period is zero. Preferably, the second scanner fixes, when it variably controls the masking period, the start point of the masking period but varies the end point of the masking point in response to the length of the light emitting period.

Figure 17:
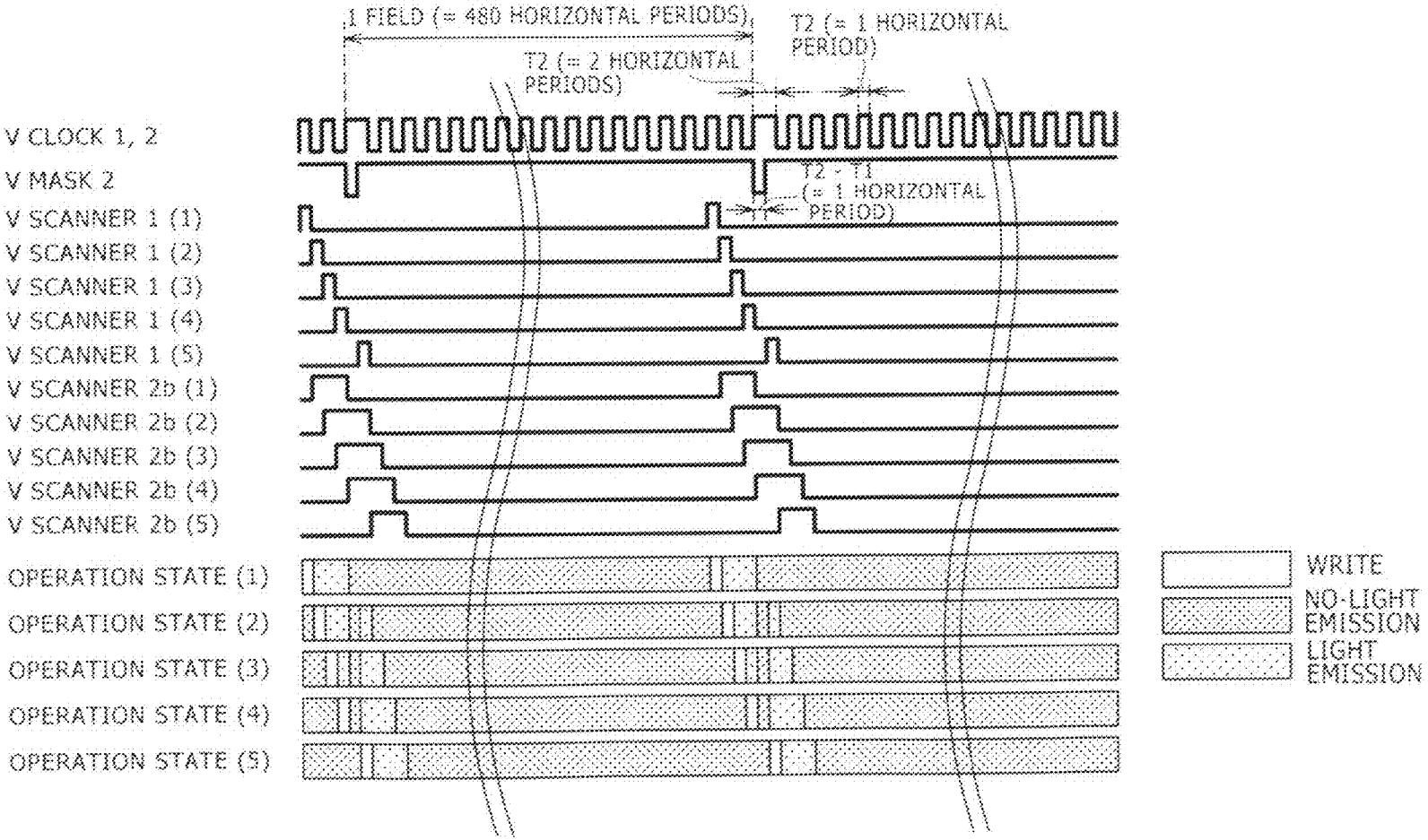
FIGS. 17 to 19 are timing charts illustrating a third mode of operation of the image display apparatus shown in FIG. 1.
Figure 18:
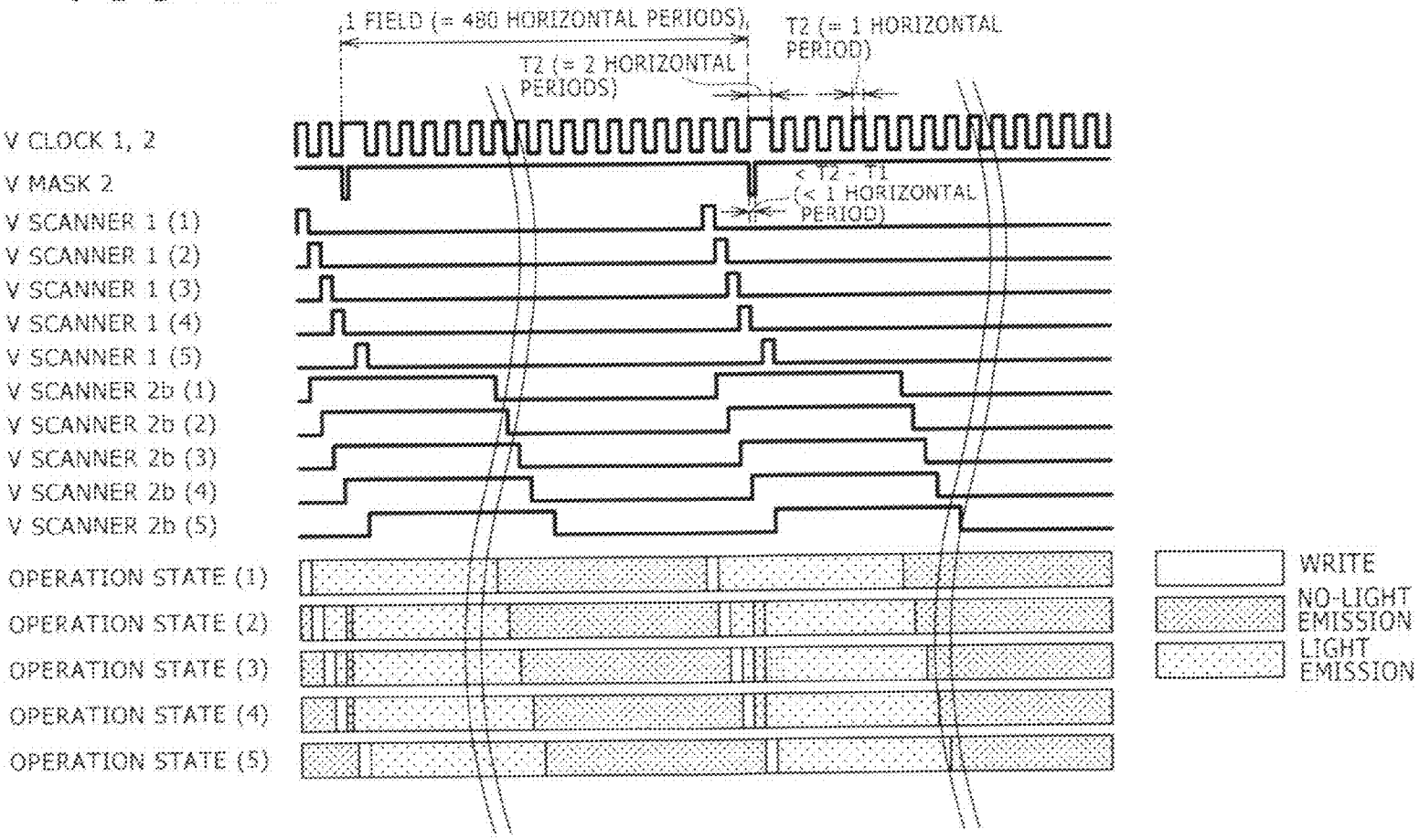
Figure 19:
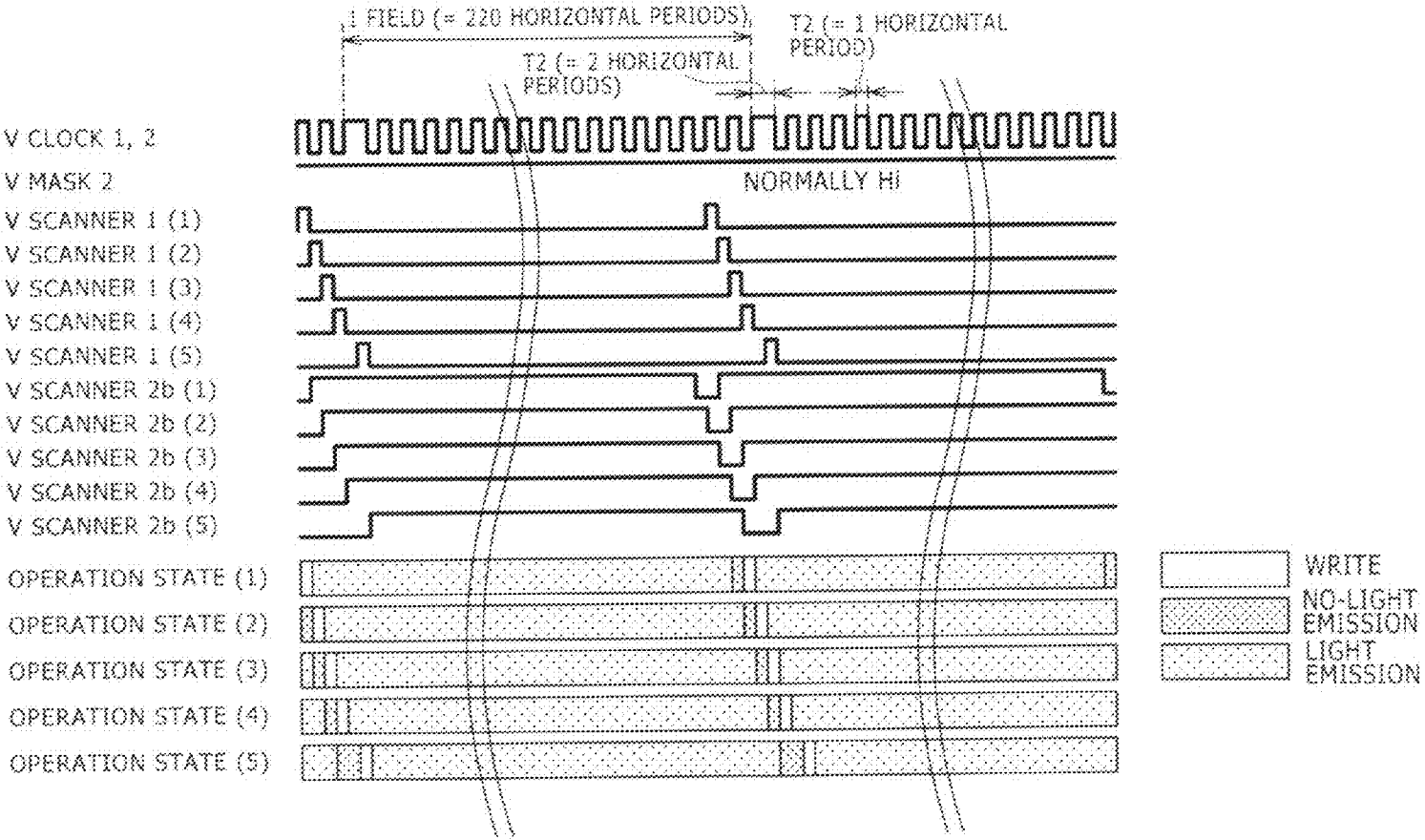

FIGS. 17 to 19 illustrate different operations of the second scanner having the configuration described above with reference to FIG. 16. The clock signal Vclock1 supplied to the first scanner and the clock signal Vclock2 supplied to the second scanner are illustrated at the top of the timing charts of FIGS. 17 to 19. In the operations illustrated in FIGS. 17 to 19, one field includes 480 horizontal periods, and the second transfer period T2 is set to 2 horizontal periods while the first transfer period T1 is set to one horizontal period. Therefore, T2−T1 is one horizontal second. Also the masking signal Vmask2 supplied to the second scanner is shown together with the clock signal Vclock2. As can be seen from FIGS. 17 to 19, the masking signal Vmask2 is outputted in conformity with the second transfer period T2 of the clock signal Vclock2. Further, also the first control signal Vscanner1(*i*) outputted from the first scanner and the second control signal Vscanner2*b*(*i*) outputted from the second scanner are illustrated. In the pixel array section 1 which includes the pixel 2 of FIG. 16, the masking signal Vmask2 is applied to the second control signal Vscanner2*b*(*i*) outputted from the second scanner to obtain the final second control signal Vscanner2*b*(*i*) to be outputted so that the light emitting elements of the pixels are controlled so as to be turned on and off in a unit of a scanning line. States of the scanning lines are indicated as the operation states (i) at a lower stage of the timing chart. The operation states (i) are divided into an image signal writing period, and a no-light emitting period and a light emitting period of the light emitting elements.

FIG. 17 illustrates operation where the ratio of the light emitting period within one field is set to the minimum period. In this instance, the time width of the masking signal Vmask2 is the maximum value (T2−T1), and the dispersion of the light emitting period between lines is eliminated fully.

FIG. 18 illustrates operation where the light emitting period is set to an intermediate period between the minimum period and the maximum period. As can be seen from the operation state (1), the light emitting period is approximately one half of one field. In this instance, the time width of the masking signal Vmask2 is smaller than T2−T1. As the light emitting period becomes long in this manner, the masking period become short. While, in FIG. 18, the number of pulses of the masking signal Vmask2 is omitted, the masking signal Vmask2 is actually outputted at a ratio of once per seven horizontal periods. Reduction of the screen luminance can be suppressed by reducing the time width of the masking signal. However, if the masking time becomes shorter than T2−T1, then although the luminance difference between scanning lines cannot be removed completely, at least it is possible to reduce the luminance difference by applying masking.

FIG. 19 illustrates operation where the light emitting period is set to the maximum period. In this instance, the time width of the masking signal Vmask2 is zero, and the masking signal Vmask2 normally exhibits the high level Hi. As a result, the loss of the luminance is eliminated and no variation occurs with the power supply load. For example, where the light emitting period has M horizontal periods in the maximum and has zero horizontal period in the minimum and the selected horizontal period is N horizontal periods, the time width of the masking signal can be set to 1−N/M horizontal periods. Where the light emitting period is set in this manner, the variation of the masking period when the light emitting period changes becomes uniform, and luminance adjustment in accordance with the variation of the light emitting period is performed smoothly. The example just described is a case wherein adjustment of the masking period is performed successively in a unit of one horizontal period. However, according to the present invention, the time width of the masking period is not limited to this, but may be changed stepwise from several to ten and several steps within the range from the minimum light emitting period to the maximum light emitting period.

Figure 20:
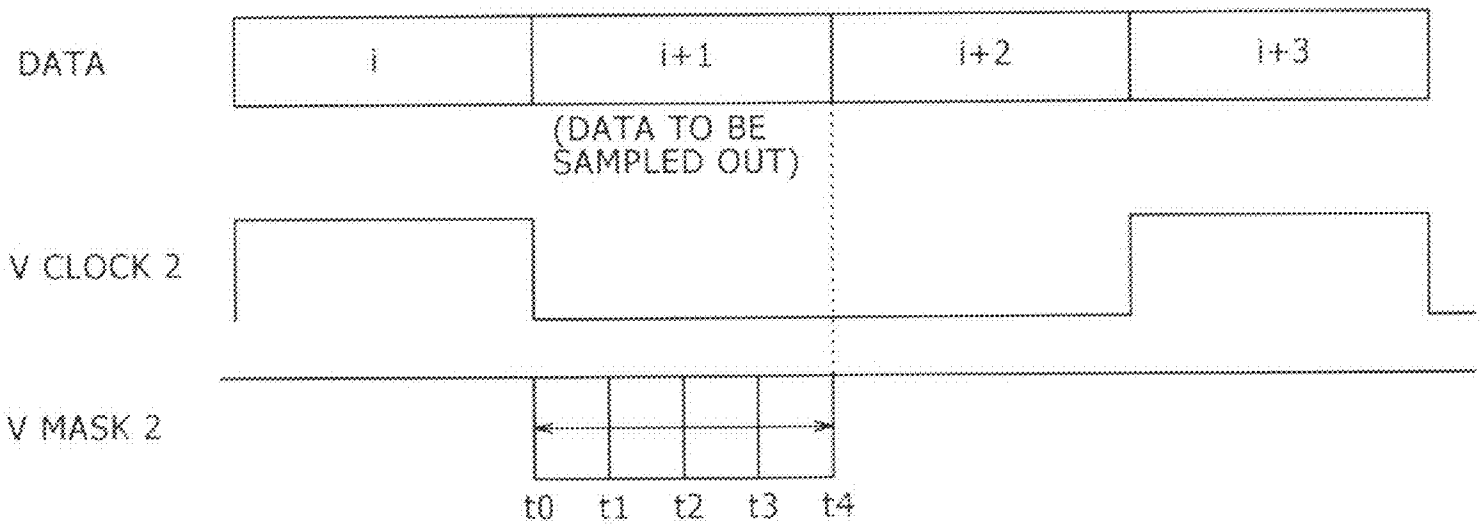
FIG. 20 is a timing chart illustrating still a further mode of operation of the image display apparatus shown in FIG. 1.

FIG. 20 illustrates stepwise changeover of the time width of the masking signal Vmask2. Referring to FIG. 20, data are indicated at an upper stage, and the clock signal Vclock2 is indicated at an intermediate stage while the masking signal Vmask2 is indicated at a lower stage. It is represented that, from among the data, the i+1th data is to be sampled out. Since the light emitting elements over the entire screen are turned off within the masking period as described hereinabove, the load variation of the power supply is great and noise is likely to be picked up. Accordingly, it is preferable to set the masking period to a period within which actual data writing is not performed as seen in FIG. 20. Further, where it is considered to variably adjust the masking period in accordance with the light emitting period, it is a matter of concern that the influence on an image may be highest at a point of time when the masking signal Vmask2 is turned off after it is turned on. Accordingly, where the masking period is variably adjusted, preferably the timing at which the light emitting periods are placed back into a light emitting state from a no-light emitting state so as to provide a period of time before the next data writing is performed. When the light emitting period is in the minimum, the end point of the masking period is set to time t4. As the light emitting period increases, the end point of the masking period is shifted stepwise forwardlike T3, T2 and T1.

While a preferred embodiment of the present invention has been described using specific terms, such description is for illustrative purpose only, and it is to be understood that changes and variations may be made without departing from the spirit or scope of the following claims.

What is claimed is:

1. An image display apparatus, comprising:

a pixel array section; and a peripheral circuit section configured to drive said pixel array section;

said pixel array section including a plurality of scanning lines extending along rows, a plurality of signal lines extending along columns, and a plurality of pixels disposed in a matrix at locations at which said scanning lines and said signal lines intersect with each other;

said peripheral circuit section having a scanner configured to supply sequential scanning signals in a predetermined transfer period to said scanning lines in order to perform line sequential scanning over one field and a driver configured to supply an image signal to said signal lines in accordance with the line sequential scanning;

each of said pixels containing a sampling transistor, a drive transistor, a switching transistor, and a light emitting element;

said sampling transistor being rendered conducting in response to a first control signal supplied from an associated first one of said scanning lines to sample an image signal supplied from an associated one of said signal lines;

said drive transistor supplying output current in response to the image signal sampled by said sampling transistor to said light emitting element;

said light emitting element emitting light with luminance in accordance with the image signal based on the output current supplied from said drive transistor;

said switching transistor being disposed in a current path along which the output current flows in such a manner as to exhibit an on state in response to a time width of a second one of the control signals supplied thereto from said second scanning line to supply the output current to said light emitting element so as to cause said light emitting element to emit light within a light emitting period in accordance with the time width;

said scanner consists of a first scanner configured to supply the first control signals to the first scanning lines and a second scanner configured to supply the second control signals to the second scanning lines;

said first scanner operating in response to a clock signal which defines a transfer period which includes ordinary first transfer periods and second transfer periods which are longer than and mixed in the first transfer periods to supply the first control signals sequentially in the first transfer periods and the second transfer periods which are mixed in the first transfer periods to the first scanning lines;

said second scanner operating in response to a clock signal synchronized with the clock signal for said first scanner to sequentially supply the second control signals to the second scanning lines, whereupon the time width of the second control signals which defines the light emitting period varies for each row due to the mixture of the first transfer periods and the second transfer periods;

said second scanner turning off the output of the second control signals in accordance with the second transfer periods thereby to adjust the light emitting period against variation caused by the mixture of the second transfer periods.

2. The image display apparatus according to claim 1, wherein said second scanner controls the output of the second control signals to an off state for a time width equal to the difference between the first transfer periods and the second transfer periods which are longer than the first transfer periods.

3. The image display apparatus according to claim 1, wherein said second scanner turns off, at a timing other than a timing at which said first scanner outputs the first control signals to the first scanning lines, the output of the second control signals of the corresponding second scanning lines.

4. The image display apparatus according to claim 1, wherein said second scanner logically ANDs the second control signals sequentially produced in response to the clock signal and a masking signal inputted from the outside in synchronism with the clock signal to control the output of the second control signals to an off state.

5. The image display apparatus according to claim 1, wherein said pixel array section has a predetermined number of scanning lines, and when said driver outputs a number of image signals greater than the number of the first scanning lines to said signal lines in accordance with the line sequential scanning, said first scanner supplies the first control signals sequentially in the first transfer periods and the second transfer periods mixed in the first transfer periods within one field thereby to sample out unnecessary ones of the image signals in a unit of a scanning line.

6. The image display apparatus according to claim 1, wherein said second scanner varies an output off period, within which the output of the second control signals is controlled to an off state in accordance with the second transfer period, in response to the light emitting period which depends upon the time width of the second control signals.

7. The image display apparatus according to claim 6, wherein said second scanner variably controls the output off period so as to decrease as the light emitting period increases.

8. The image display apparatus according to claim 7, wherein said second scanner can vary the time width of the second control signals to variably adjust the light emitting period within a range from a minimum light emitting period to a maximum light emitting period within one field, and controls the output off period such that, when the light emitting period is the minimum light emitting period, the output off period is equal to the difference between the first transfer periods and the second transfer periods which are longer than the first transfer periods.

9. The image display apparatus according to claim 8, wherein said second scanner controls the output off period so as to be zero when the light emitting period is the maximum light emitting period.

10. The image display apparatus according to claim 7, wherein, when said second scanner variably controls the output off period, said second scanner fixes the start point of the output off periods but varies the end point of the output off periods in response to the length of the light emitting period.

11. An image display apparatus, comprising:

a pixel array section; and a peripheral circuit section configured to drive said pixel array section;

said pixel array section having a plurality of scanning lines extending along rows, a plurality of signal lines extending along columns, and a plurality of pixels disposed in a matrix at locations at which said scanning lines and said signal lines intersect with each other;

said peripheral circuit section having a scanner configured to supply sequential scanning signals in a predetermined transfer period to said scanning lines in order to perform line sequential scanning over one field and a driver configured to supply an image signal to said signal lines in accordance with the line sequential scanning;

each of said pixels containing a sampling transistor, a drive transistor, a switching transistor, and a light emitting element;

said sampling transistor being rendered conducting in response to a first control signal supplied from an associated first one of said scanning lines to sample an image signal supplied from an associated one of said signal lines;

said drive transistor supplying output current in response to the image signal sampled by said sampling transistor to said light emitting element;

said light emitting element emitting light with luminance in accordance with the image signal based on the output current supplied from said drive transistor;

said switching transistor being disposed in a current path along which the output current flows in such a manner as to exhibit an on state in response to a time width of a second one of the control signals supplied thereto from said second scanning line to supply the output current to said light emitting element so as to cause said light emitting element to emit light within a light emitting period in accordance with the time width;

said scanner consists of a first scanner configured to supply the first control signals to the first scanning lines and a second scanner configured to supply the second control signals to the second scanning lines;

said first scanner operating in response to a first clock signal which defines a transfer period which includes ordinary first transfer periods and second transfer periods which are longer than and mixed in the first transfer periods to supply the first control signals sequentially in the first transfer periods and the second transfer periods which are mixed in the first transfer periods to the first scanning lines;

said second scanner operating in response to a second clock signal which defines a third transfer period different from the first and second transfer periods to sequentially supply the second control signals having a predetermined time width to the second scanning lines such that the light emitting period of the pixels of the rows without being influenced by the mixture of the first and second transfer periods.

12. The image display apparatus according to claim 11, wherein said second scanner operates in response to a second clock signal which defines a fixed third transfer period to sequentially supply the second control signals having a same time width to said second scanning lines such that the light emitting period of the pixels of the rows is controlled so as to be always same without being influenced by the mixture of the first and second transfer periods.

13. The image display apparatus according to claim 11, wherein said second scanner operates in response to a clock signal which defines a third transfer period which is equal to an average value of the transfer periods in which the first and second transfer periods are mixed.

14. The image display apparatus according to claim 11, wherein each of said pixels further includes a correcting transistor configured to cooperate with said switching transistor to perform a correction operation of said drive transistor within a predetermined correction period, and said scanner includes, in addition to said first and second scanners, a third scanner configured to supply a third control signal to said correcting transistor through a third one of said scanning lines, said third scanner sequentially outputting the third control signals to the third scanning lines in response to a clock signal synchronized with the second clock signal which is supplied to said second scanner.

15. The image display apparatus according to claim 11, wherein each of said pixels further includes a correcting transistor configured to cooperate with said switching transistor to perform a correction operation of said drive transistor within a predetermined correction period, and said scanner has, in addition to said first and second scanners, a third scanner configured to supply a third control signal to said correcting transistor through a third one of said scanning lines, said third scanner sequentially outputting the third control signals to the third scanning lines in response to a clock signal synchronized with the first clock signal which is supplied to said second scanner.

16. The image display apparatus according to claim 11, wherein each of said pixels further includes a correcting transistor configured to cooperate with said switching transistor and said sampling transistor to perform a correction operation of said drive transistor within a predetermined correction period, and said second scanner has a shift register configured to produce the second control signals in response to the second clock signal, another shift register configured to produce additional control signals in response to the first clock signal, and an outputting section configured to output the sums of the additional control signals and the second control signals to the second scanning lines of the rows, said scanner including, in addition to said first and second scanners, a third scanner configured to supply the third control signals to the correcting transistors through third scanning lines, said third scanner sequentially outputting the third control signals to the third scanning lines in response to a clock signal synchronized with the first clock signal supplied to said first scanner.

17. The image display apparatus according to claim 11, wherein said pixel array section has a predetermined number of scanning lines, and when said driver outputs a number of image signals greater than the number of the first scanning lines to said signal lines in accordance with the line sequential scanning, said first scanner supplies the first control signals sequentially in the first transfer periods and the second transfer periods mixed in the first transfer periods within one field thereby to sample out unnecessary ones of the image signals in a unit of a scanning line.

* * * * *